US010470534B2

(12) United States Patent
Kakadiya

(10) Patent No.: US 10,470,534 B2
(45) Date of Patent: Nov. 12, 2019

(54) PROCESS OF CUTTING AND ASSEMBLING DIAMONDS TO FORM COMPOSITE DIAMOND HAVING ENHANCED BRILLIANCE AND SHADE

(71) Applicant: SKSM DIAMONDS IMPEX LIMITED, Gujarat (IN)

(72) Inventor: Maheshbhai Shambhubhai Kakadiya, Gujarat (IN)

(73) Assignee: SKSM Diamonds Impex Limited, Gujarat (IN)

( * ) Notice: Subject to any disclaimer, the term of this patent is extended or adjusted under 35 U.S.C. 154(b) by 0 days.

(21) Appl. No.: 15/553,096

(22) PCT Filed: Oct. 3, 2016

(86) PCT No.: PCT/IN2016/050334

§ 371 (c)(1),
(2) Date: Aug. 23, 2017

(87) PCT Pub. No.: WO2018/015968

PCT Pub. Date: Jan. 25, 2018

(65) Prior Publication Data

US 2019/0133269 A1 May 9, 2019

(30) Foreign Application Priority Data

Jul. 18, 2016 (IN) ..... 201621024478

(51) Int. Cl.
*A44C 17/00* (2006.01)

(52) U.S. Cl.
CPC ..... *A44C 17/002* (2013.01); *A44C 17/001* (2013.01)

(58) Field of Classification Search
CPC ..... A44C 17/002; A44C 17/001
(Continued)

(56) References Cited

U.S. PATENT DOCUMENTS 3,394,692 A * 7/1968 Sirakian ..... A44C 17/001 125/30.01
5,190,024 A * 3/1993 Senanayake ..... A44C 17/001 125/30.01

(Continued)

FOREIGN PATENT DOCUMENTS

WO 0227075 A2 4/2002

OTHER PUBLICATIONS

International Search Report from corresponding PCT/IN2016/050334 dated May 23, 2017.

*Primary Examiner* — George B Nguyen
(74) *Attorney, Agent, or Firm* — Caesar Rivise, PC

(57) ABSTRACT

The present invention is a novel technique for setting a multiplicity of diamonds such as diamonds into a unique setting to enhance the beauty and presentation, with the technique including steps of assorting, blocking, mapping, sawing, polishing, assembling and grooving of assembling of white, naturally colored and treated color natural diamonds. The present invention provides method where each diamonds is separately processed for ultimate brilliance and cumulative refraction. The flat surfaces of the adjacent diamond are joined to form the complete design in the system. The assembled diamonds are arranged by grooving and providing support to form final pattern of the jewelry. The present process is advantageous with regards to usage of maximum utilization of raw diamond and process that gives great brilliance of large diamond and expensive appearance to user.

11 Claims, 52 Drawing Sheets

(58) Field of Classification Search
USPC ..... 125/30.01
See application file for complete search history.

(56) References Cited

U.S. PATENT DOCUMENTS

| | | | | |
|---|---|---|---|---|
| 5,533,364 | A | 7/1996 | Freilich et al. | |
| 6,065,307 | A * | 5/2000 | Freilich | A44C 17/002 63/26 |
| 6,378,335 | B1 * | 4/2002 | Siebenberg | A44C 17/002 63/32 |
| 2001/0020370 | A1 | 9/2001 | Haimoff | |
| 2002/0088450 | A1 * | 7/2002 | Shuto | A44C 17/001 125/30.01 |
| 2002/0096167 | A1 * | 7/2002 | Shuto | A44C 17/001 125/30.01 |
| 2003/0046955 | A1 | 3/2003 | Elishyov | |
| 2010/0282234 | A1 * | 11/2010 | Matsumura | A44C 17/001 125/30.01 |
| 2011/0239705 | A1 * | 10/2011 | Matsumura | A44C 17/001 63/32 |
| 2011/0265514 | A1 * | 11/2011 | Fakier | A44C 17/001 63/12 |
| 2013/0055763 | A1 * | 3/2013 | Ritchie | A44C 17/001 63/32 |
| 2013/0319045 | A1 * | 12/2013 | Ritchie | A44C 17/001 63/32 |
| 2014/0190209 | A1 * | 7/2014 | Lipton | A44C 27/00 63/28 |
| 2014/0352354 | A1 * | 12/2014 | Mandell | A44C 17/003 63/32 |

* cited by examiner

A
A
A

E
E
E

E
D
E
D
E
D

D
D
D
D
E
E
E

A
A
A
A
C
C
C
C
B
B
B

A
A
A
A
B
B
B

E
E
E

PROCESS OF CUTTING AND ASSEMBLING DIAMONDS TO FORM COMPOSITE DIAMOND HAVING ENHANCED BRILLIANCE AND SHADE

CROSS-REFERENCE TO RELATED APPLICATIONS

This application is a U.S. National Phase Application of PCT/IN2016/050334, filed Oct. 3, 2016, which claims priority from IN 201621024478, filed Jul. 18, 2016, the contents of which applications are incorporated herein by reference in their entireties for all purposes.

FIELD OF THE INVENTION

The present invention relates to process of cutting and assembling diamonds to form composite diamond having enhanced brilliance and shade. More particularly the present invention relates to a process of cutting and assembling natural diamonds, naturally colored and treated color natural diamonds to form composite diamond. The present invention focuses on the area of jewelry which is involved with cutting and assembling precious diamonds in particular arrangements that enhance their visual characteristics and size in lower cost.

BACKGROUND OF THE INVENTION

Jewelry designers and manufacturers constantly strive to evolve new and more interesting jewelry designs and invest in a great deal of resources, both monetary and in the form of human resources, in attempts to innovate new designs, new styles, and new exciting looks in jewelry. Further, development in society and level of our daily life, demands for diamonds are increased rapidly. As a special kind of minerals, diamonds have brilliant external characteristics and deep internal connotations, and thereby are cherished by the public. Diamonds are usually applied to ornaments, such as necklace pendants, eardrops, rings, etc. The existing methods for mounting diamonds on ornaments mainly include claw or prong setting, pave setting, channel setting, bezel setting, invincible setting, and so on. In the above-mentioned prior setting manners, the diamonds should be supported from the pavilions of the diamonds, or even need to be covered and only expose tables and crowns. Thus, it is not sufficient for light to enter into the diamonds for refraction, which may lower brilliance of the diamonds.

With rapid exhaustion of diamond resource, price of diamond of large size is becoming increasingly expensive. In field of jewelry, it is difficult for a normal consumer to buy jewelry inlaid with diamond having weight of more than I ct (carat). Though small-sized diamond has a low price, a general consumer likes diamond of large size.

In recent years, in order for a general consumer to get with low price jewelry having effect of large-sized diamond, technicians of diamond jewelry fabrication have developed kinds of diamond combining techniques for simulating effect of large sized diamond using some small sized diamond.

At first, to hold these small diamonds in place stably so as to prevent falling of them, metal retention means is mainly used to mount a central diamond surrounded by several small diamonds. This construction however, results in existence of gaps between the central diamond and small diamonds.

Secondly, neither of the above prior art techniques is able to design size of the small diamond contained in this combinative diamond and angle of the circular base support based on cutting angle of true diamond. It is impossible to form entire shining visual effects by mutual refraction and reflection of these small diamonds according to specific size ratio of the small diamonds to metal part and shape design. As such, there is certain difference between it and true large sized diamond in terms of shape and visual effect Presently various remedies in the prior arts were available in the field diamond setting which shows composite diamond settings in the field of combinative arrangements that mainly includes melee diamonds and pave diamonds.

Chinese Patent No. CN200710076738 has disclosed modular insertion diamond jewelry. According to this disclosure, a noble metal base having a conic bottom surface is provided. A plurality of diamond bores is defined in a top surface of the base for locating diamonds. In addition, a clamping protrusion is disposed between the diamonds bores formed along the periphery.

All of the above prior art have various limitation such as not useful for diversified dimension, various color diamonds arrangement to give overall brilliance, maximum utilization of any sized diamonds etc.

In conclusion none of the prior art provides process for diamond cutting and assembling that provides excellent brilliance, shade and size utilization of raw diamonds and enrich look in economical cost.

SUMMARY OF THE INVENTION

The present invention relates to a process of cutting and assembling diamonds to form composite diamond having enhanced brilliance and shade. The present invention is a novel technique for setting a multiplicity of precious diamonds such as diamonds into a unique setting to enhance the beauty and presentation of the multiplicity of set diamonds, with the technique including steps of assorting, blocking, mapping, polishing, grooving, arranging, adhering and buffing. The present invention provides method where each diamonds is separately processed for ultimate brilliance and cumulative refraction and reflection to give enhanced brilliance, shade and size. The flat surfaces of the adjacent diamond are joined to form the complete design in the system. The assembled diamonds are arranged by grooving and providing support to form final pattern of the jewelry. The present process is advantageous with regards to usage of maximum utilization of raw diamond and simple process that gives great brilliance of large diamond and expensive appearance to user.

OBJECTIVE OF THE INVENTION

The main objective of the present invention is to provide a process of cutting and assembling diamonds to form composite diamond having enhanced brilliance and shade.

The another objective of the invention to provide a process of cutting and assembling natural diamonds, naturally colored and treated color natural diamonds to form composite diamond.

The further objective of the present invention is to provide the composite diamond with the different size and shape.

Another object of the invention is to provide a setting of the diamonds in such a way that the passage of light sparkle the diamonds, thus enhancing the overall appearance, brilliance, shade and size.

Yet another object of this invention is to provide a composite diamond which is susceptible of widespread use, commercial significance and will be economically valuable to the user by providing a composite diamond of significantly enhanced brilliance and shade as compared to the cost of the individual diamonds.

The object of the present invention is to provide economical process to have diamond with great brilliance and shade through cumulative reflection and refraction in the system.

DETAILED DESCRIPTION OF THE INVENTION

Figure 1:
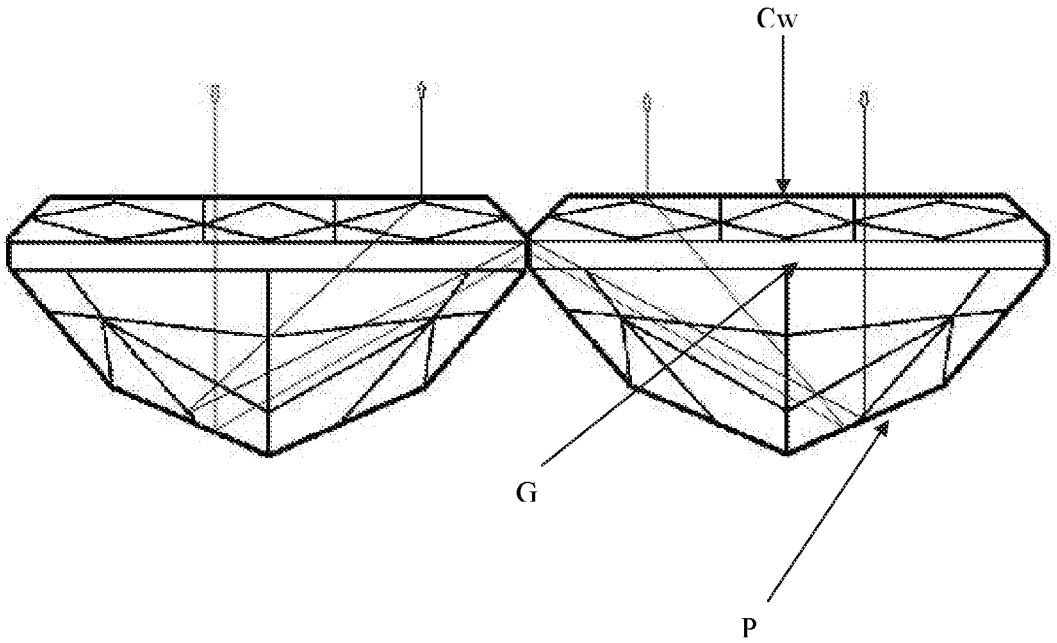
FIG. 1 shows basic concept of cumulative refraction and reflection of the present invention.

Before explaining the present invention in detail, it is to be understood that the invention is not limited in its application to the details of the construction and arrangement of parts illustrated in the accompany drawings. The invention is capable of other embodiments, as depicted in figure as described above and of being practiced or carried out in a variety of ways. It is to be understood that the phraseology and terminology employed herein is for the purpose of description and not of limitation.

The present invention relates to process of cutting and assembling natural diamonds, naturally colored and treated color natural diamonds to form composite diamond with enhance brilliance. The diamonds are precious natural resources which are obtained as a raw diamonds from mines. In general, brilliant diamonds have crown, pavilion, girdle and facets. The brilliance depends on its very bright and smooth surface for reflection in combination with its high refractive index. Diamonds are cut in such a manner that when a viewer is looking at the crown/table, the light entering the diamond through the table/crown is reflected within the diamond by the pavilion's facets and units through facets on the crown or the table for the benefit of the viewer.

The process of cutting and assembling diamonds to form composite diamond having enhanced brilliance and shade comprises following steps on raw diamonds:

Assorting the small diamonds from raw diamonds based on clarity and color, each assorted diamonds as per the ultimate design, mapping each blocked diamonds in manner that minimize the waste and optimize the use of maximum diamond.

The assorting mainly focuses on parameters like size, purity and design etc. The present invention mainly involves forming composite diamond from white, naturally colored and treated color diamonds. The naturally colored and treated color diamonds include pink, yellow, blue green and other color diamonds. In many diamonds, though, color is quite subtle. In addition, colors that result from atomic-level impurities or defects may be evenly or unevenly distributed within the rough crystal. Color can also result from the presence of a colored inclusion(s), or from staining (usually brown) by a foreign material within a surface-reaching fracture. These impurities are removed to manifest the exact color. The color treated diamond refers to the natural diamonds and the diamonds which are processed by radiation treatment to coat the artificial color. Further present invention uses various 8 shades i.e. faint, very light, light, fancy light, fancy, fancy intense, fancy deep, fancy vivid in the diamond for creating variety in the diamonds. The process of assortment is also focused on the purity or clarity of raw diamonds where rough diamonds are sorted in terms of their potential clarity grade. As with color grades, the better clarity grades are only distinguished by slight differences, such as in the number, visibility, position, and size of internal features (inclusions, fractures etc.), as these features would appear in the final faceted diamonds.

The process of blocking involves positioning each assorted diamonds for the process of mapping the diamonds. The process of blocking is important because the same is crucial for ultimate brilliance, shade and size. The blocking involves the process of separating diamonds from the assorted diamonds with respect to purity and proposed design. The blocks are established based on proposed design and number of pieces intended to form as combinative purpose. These blocks are prepared via horizontally mounted circular cast iron disc known as scaife of the blocking machine.

The process of mapping involves magnification of each blocked diamond in the machine to have cut of the design. The process of mapping will figure out the best possible shapes of the diamond in order to minimize waste and maximize the yield of the rough diamonds. The process of mapping also focused on various defects in the raw diamonds i.e. flawless, internally flawless, very slightly included that changes design for more perfect shape.

The process of cutting is performed on laser machine. The process of cutting in the present invention does not refer only to a diamond's shape but to a diamond's proportions, symmetry and polish. The present invention provides wide range of combinations that are possible, ultimately determining the diamond's interaction with light. In general when light strikes a diamond, approximately 20% immediately reflects off the surface (as glare) and 80% of remaining that enters, a portion will escape through the bottom of the diamond (where the observer cannot appreciate it). The present invention will proportion diamond that have each facet properly placed and angled so as to maximize the amount of light that reflects back out of the crown (top) of the diamond, to the eye of the observer.

The present invention provides combinative principle in small brilliant cut diamonds that assembled to have overall brilliance through cumulative reflection and refraction in system. Each diamond is cut to have three main portions i.e. a crown (Cw), a girdle (G) and a pavilion (P) in which the girdle (G) is the widest portion around the diamond forming a thin circle. When viewed from a side, the girdle (G) is in form of a line, i.e. a girdle line. The crown (Cw) is a trapezoid portion above the girdle (G), while the pavilion (P) is a triangle portion below the girdle (G).

The pavilion of diamond of the subject invention is cut to have at least three main facets (A) angularly pointed toward periphery, at least three secondary facets (B1, B2) between two main facets (A) and at least one tertiary facet (C) on at least one of periphery. The secondary facets (B1, B2) are either angularly pointed toward the main facets (A) or toward the periphery. The main facets of the pavilion (P) of the diamond are cut within the angle degree of 25° to 30°. The secondary facets (B1,B2) of the pavilion (P) of the diamond are cut within the angle degree of 27° to 32°. The tertiary facet (C) of the pavilion (P) of the diamond is cut within the angle degree of 55° to 60°.

The crown (Cw) of diamond of the subject invention is cut to have flat facet (T) and at least one main facet (D) on at least one of periphery. In another embodiment the crown (Cw) of diamond of the subject invention is cut to have flat facet (T), at least one main facets (D) having at least one angle in contact with the flat facet (T), two secondary facets (E) between the flat facet (T) and at least one tertiary facet (F) and on the periphery. The main facets (D) of the crown (Cw) of the diamond are cut within the angle degree of 28° to 31°. The secondary facets (E) of the crown (Cw) of the diamond are cut within the angle degree of 20° to 25°. The tertiary facets (F) of the crown (Cw) of the diamond are cut within the angle degree of 32° to 35°.

The crown (Cw) height, pavilion (P) height and girdle (G) thickness of each diamond to form the composite diamond ranges from 5 to 8%, 40 to 45% and 10 to 15%. The L/W ratio and total depth of each diamond varies considering crown (Cw) height, pavilion (P) height and girdle (G) thickness due to change in design.

The step of polishing is done by setting the diamonds in a mechanical clamp also known as tang and holding it down on a revolving cast-iron lap (horizontal, circular disk) also known as scaife of the machine, that has been charged with diamond dust. Further, the present invention focuses on individual diamonds polishing where facets of adjacent diamonds are sharing at least one side of the diamonds therefore the polishing of the said side is performed at the same grade as precedent diamonds grade. The polishing of the flat surface is done with the care of refracting angle and refractive index consideration. The step of polishing includes the formation of girdle (G), overall proportions, such as table size, crown (Cw) angle, pavilion (P) depth percentage and facets for each piece which shares the same with adjacent piece.

The step of grooving is done by the mounting the polished diamond pieces together as per the design of the jewelry.

The basic principle and the step of arranging diamonds to form composite diamond of the present invention is described in FIG. 1 where it is observed that cumulative reflection and refraction in two diamonds if they placed in specific arrangement i.e. the diamond having at least one straight edges girdle (G) is placed together. At least three diamonds are held adjacent to each other along a respective single straight edge of the girdle (G) of the diamonds.

In another embodiment, the diamond having at least one straight edges girdle (G) and at least one tertiary facet (C) of the pavilion is placed together.

The composite diamond according to the present invention includes but not limited to shapes or combination thereof i.e. heart, pear, flower, radiant, rectangular, round, marquise and star. FIG. 2-52 describes different shapes of the composite diamond prepared from different number of individual diamonds. In these figures number of diamond is sequentially mentioned.

The composite diamond according to the present invention when a viewer is looking at the crown, the light entering the diamond through the crown is reflected within various diamonds by the flat adjacent surfaces i.e. united through girdles (G) in a manner that ultimately reflected out from the crown (Cw) as the enhanced brilliance for the benefit of the viewer. The brilliance is enhanced through preventing loss of light, in combinative system the factors like refractive index, number of refraction, angle of refraction and arrangement of closely packed diamond system. The refractive angle of the diamond is 22° to 24° and the same is important to prevent loss of light and brilliance enhancement.

The adhering is important as ultimate brilliance and diamonds setting is governed by successful mounting of pieces on metal wire or other abstracts. The metal used for the purpose of adhering mainly includes but not limited to gold and platinum. This binding is also made by the metal wire duly fixed in the groove made in the girdle (G). In addition, adhering of diamonds is performed via chemical treatment and subsequent washing. In other embodiment setting of a center diamonds held by small prongs, an outer series of diamonds wherein each outer diamonds is held by a pair of large prongs, and an intermediate series of diamonds held by the larger outer prongs which hold the small diamonds so that the intermediate diamonds partially cover the center diamonds and outer series of diamonds in a manner which conceals the way the outer diamonds are held.

Once the composite diamond is prepared if it required it is buffed.

After that the final jewelry is evaluated in for combinative effects of the facet shapes and angles, girdle (G) width, culet size, polish and symmetry on the overall appearance of a diamond.

The invention is illustrated more in details in the following example. The example describes and demonstrates embodiments within the scope of the present invention. This example is given solely for the purpose of illustration and is not to be construed as limitations of the present invention, as many variations and other designs thereof are possible without departing from spirit and scope. Different shapes of the composite diamonds using the present invention is prepared by following example.

Figure 2:
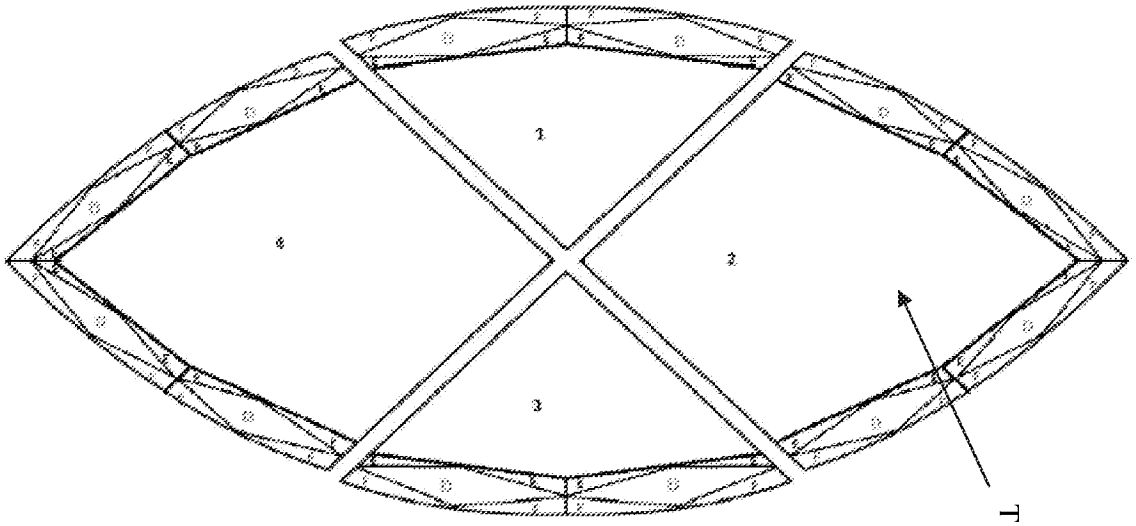
FIG. 2 shows top view of marquise design with four assembled diamonds.
Figure 3:
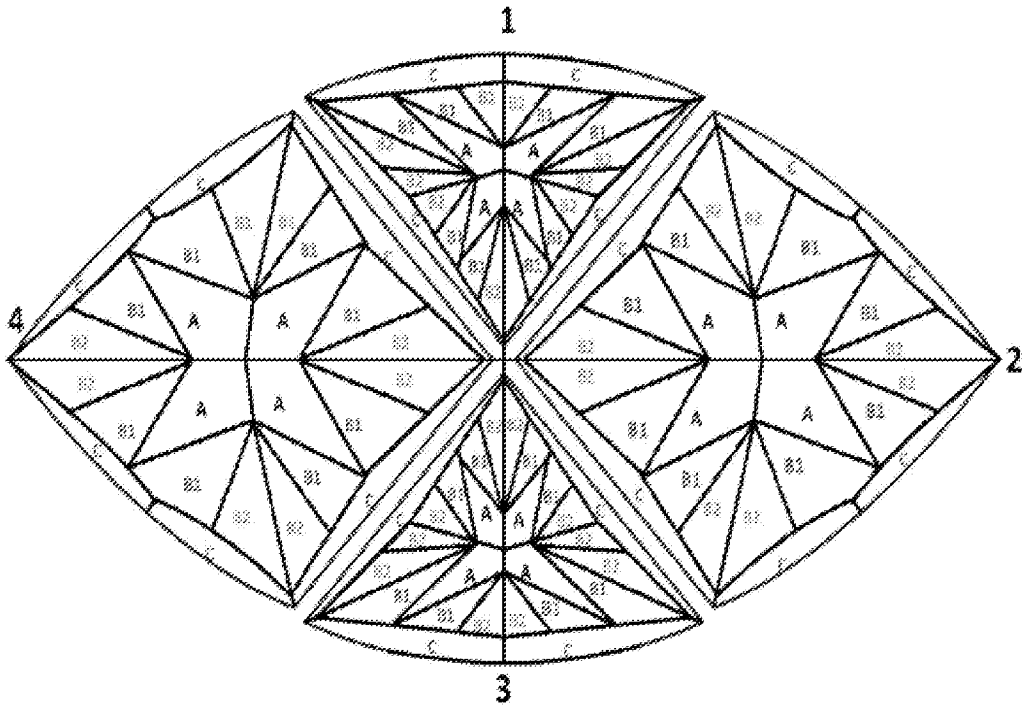
FIG. 3 shows bottom view of marquise design with four assembled diamonds.
Figure 4:
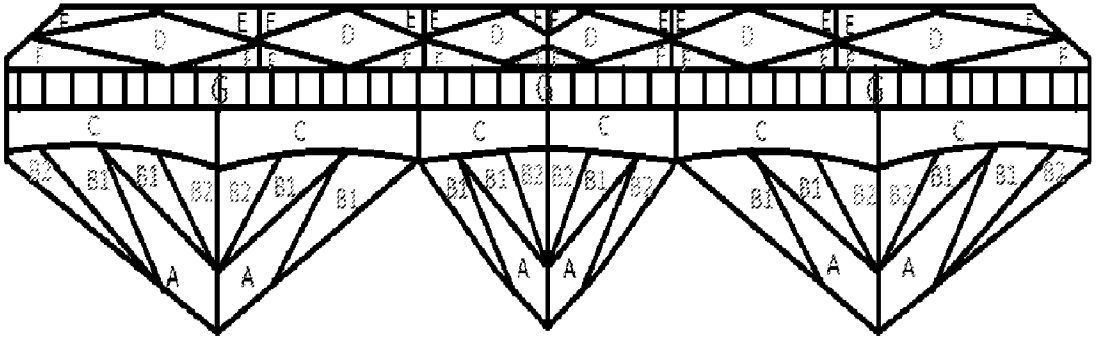
FIG. 4 shows side view of marquise design with four assembled diamonds.

FIGS. 2-4 show the marquise shaped composite diamond. Below Table 1 shows specification of it.

TABLE 1

| 1 | | 2 | | 3 | | 4 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | 28° TO 31° |
| E | 20° TO 25° | E | 20° TO 25° | E | 20° TO 25° | E | 20° TO 25° |
| F | 32° TO 35° | F | 32° TO 35° | F | 32° TO 35° | F | 32° TO 35° |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.60 TO 0.70 | L/W RATIO | 1.20 TO 1.30 | L/W RATIO | 0.60 TO 0.70 | L/W RATIO | 1.20 TO 1.30 |
| TOTAL DEPTH | 55% TO 60% | TOTAL DEPTH | 55% TO 60% | TOTAL DEPTH | 55% TO 60% | TOTAL DEPTH | 55% TO 60% |

Figure 5:
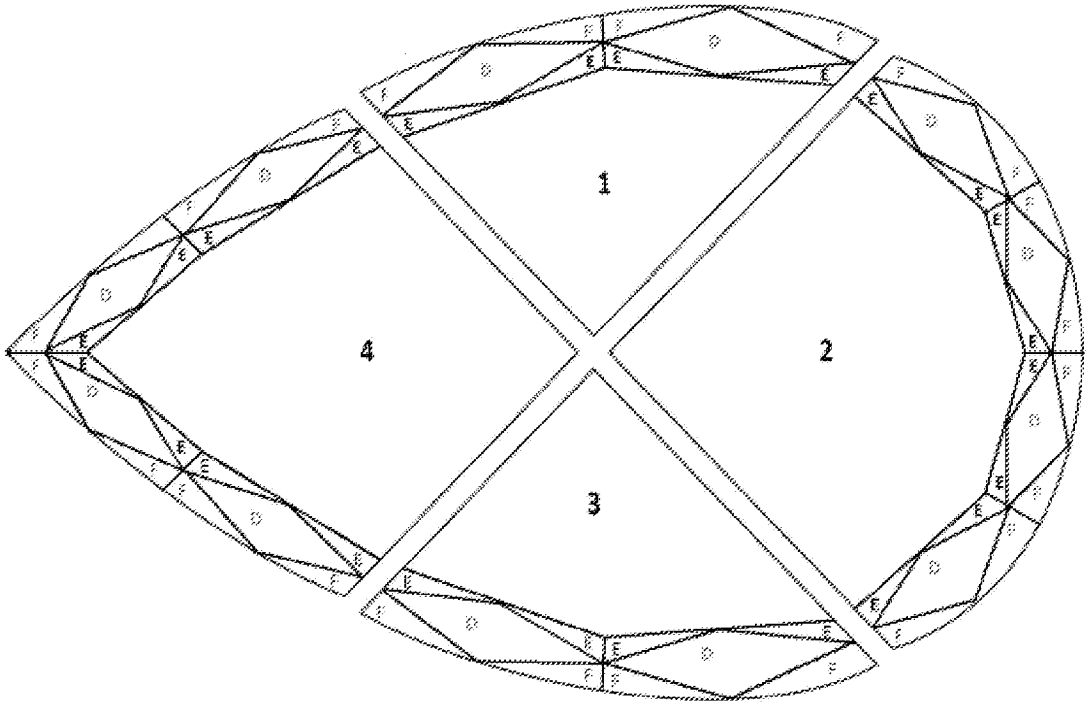
FIG. 5 shows top view of pear design with four assembled diamonds.
Figure 6:
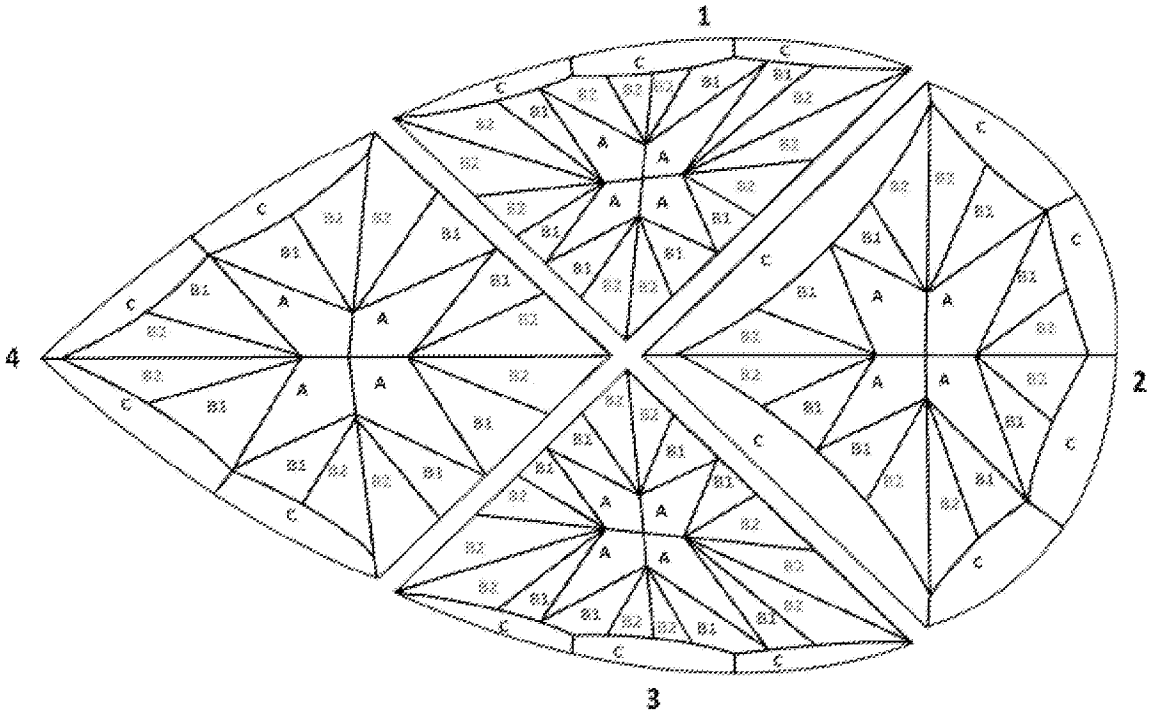
FIG. 6 shows bottom view of pear design with four assembled diamonds.
Figure 7:
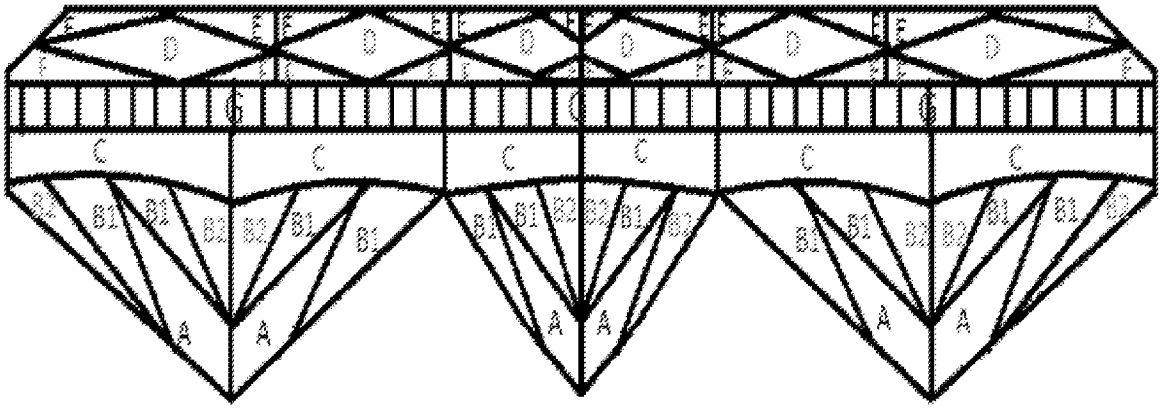
FIG. 7 shows side view of pear design with four assembled diamonds.

FIGS. 5-7 show the pear shaped composite diamond prepared from four diamonds. Below Table 2 shows specification of it.

TABLE 2

| 1 | | 2 | | 3 | | 4 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | 28° TO 31° |
| E | 20° TO 25° | E | 20° TO 25° | E | 20° TO 25° | E | 20° TO 25° |
| F | 32° TO 35° | F | 32° TO 35° | F | 32° TO 35° | F | 32° TO 35° |
| G | 90° | G | 90° | G | 90° | G | 90° |

TABLE 2-continued

| 1 | | 2 | | 3 | | 4 | |
|---|---|---|---|---|---|---|---|
| CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.60 TO 0.70 | L/W RATIO | 0.80 TO 0.85 | L/W RATIO | 0.60 TO 0.70 | L/W RATIO | 1.20 TO 1.30 |
| TOTAL DEPTH | 55% TO 60% | TOTAL DEPTH | 55% TO 60% | TOTAL DEPTH | 55% TO 60% | TOTAL DEPTH | 55% TO 60% |

Figure 8:
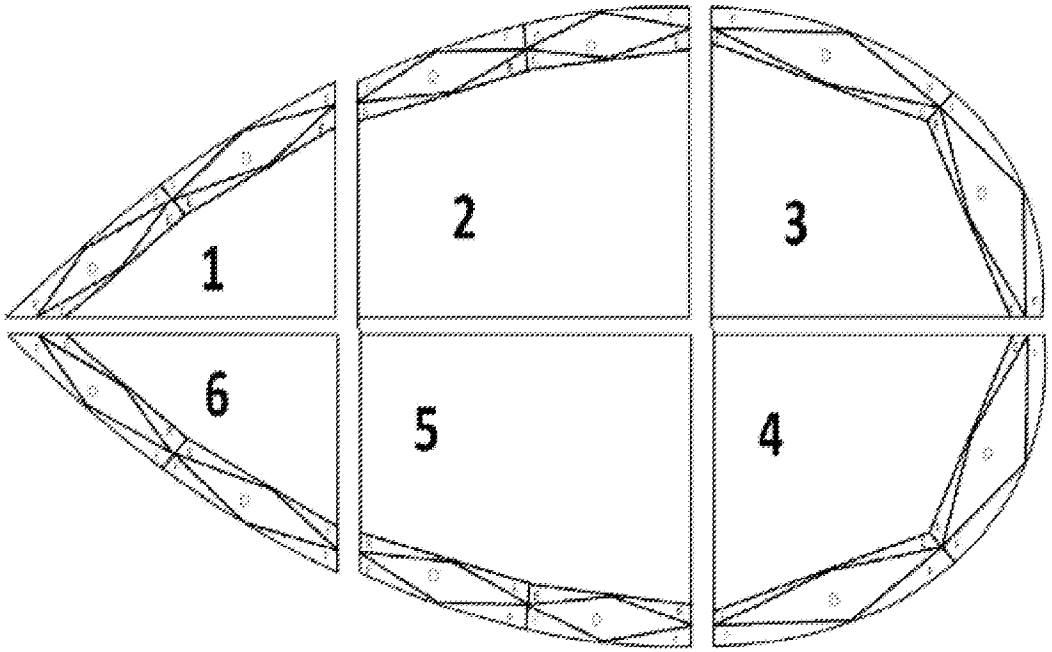
FIG. 8 shows top view of pear design with six assembled diamonds.
Figure 9:
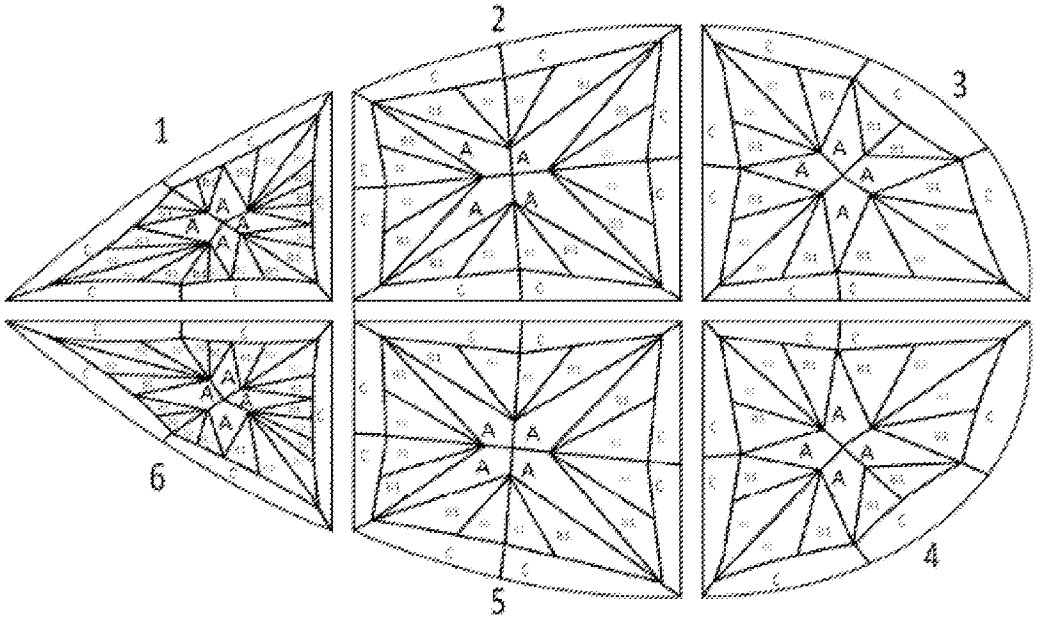
FIG. 9 shows bottom view of pear design with six assembled diamonds.
Figure 10:
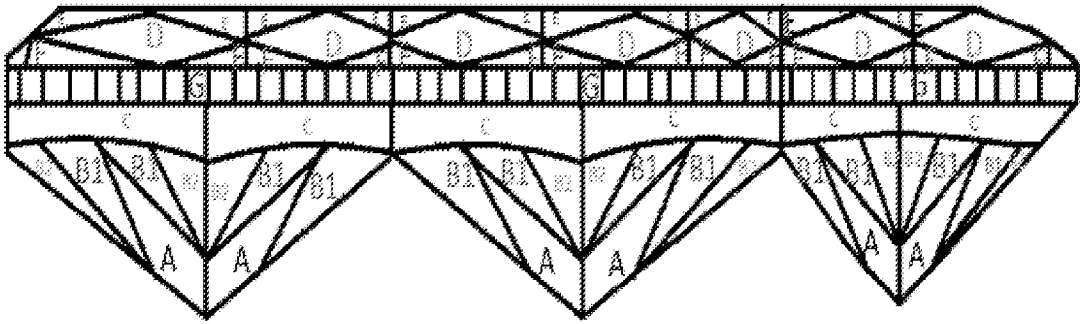
FIG. 10 shows side view of pear design with six assembled diamonds.

FIGS. 8-10 show the pear shaped composite diamond prepared from six diamonds. Below Table 3 shows specification of it.

TABLE 3

| 1 | | 2 | | 3 | |
|---|---|---|---|---|---|
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GERDLE THICKNESS | 10% TO 15% |
| L/W RATIO | 1.60 TO 1.75 | L/W RATIO | 1.15 TO 1.20 | L/W RATIO | 1 TO 1.0 |
| TOTAL DEPTH | 55% TO 60% | TOTAL DEPTH | 55% TO 60% | TOTAL DEPTH | 55% TO 60% |
| **4** | | **5** | | **6** | |
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% |
| L/W RATIO | 1 TO 1.10 | L/W RATIO | 1.15 TO 1.20 | L/W RATIO | 1.60 TO 1.75 |
| TOTAL DEPTH | 55% TO 60% | TOTAL DEPTH | 55% TO 60% | TOTAL DEPTH | 55% TO 60% |

Figure 11:
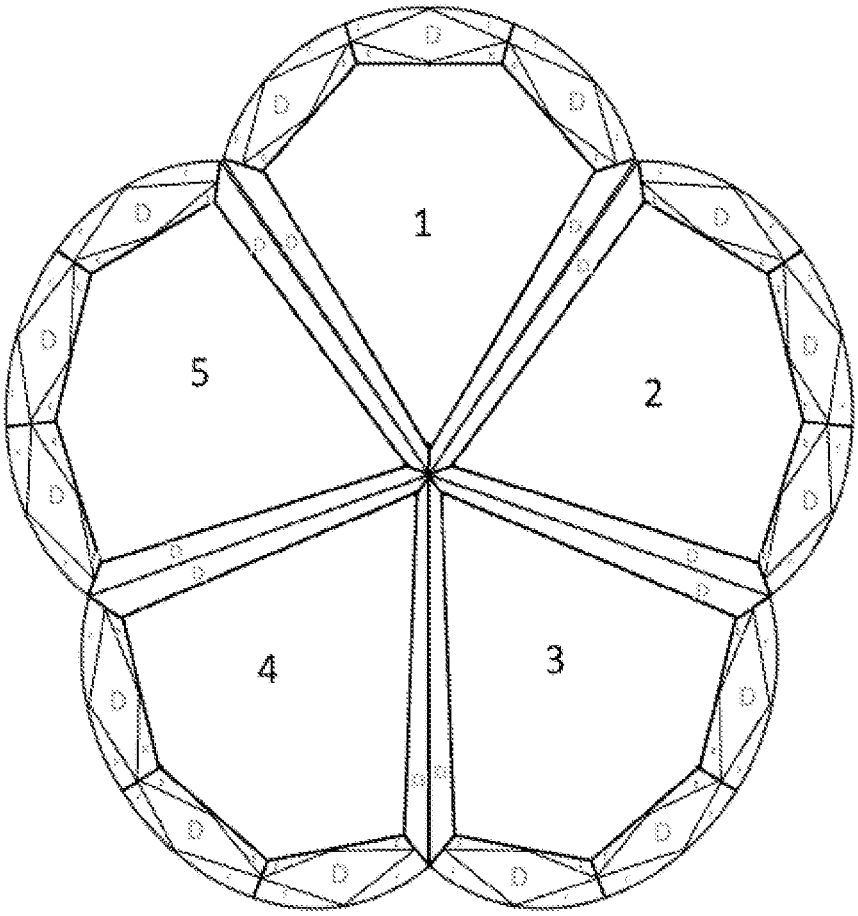
FIG. 11 shows top view of flower design with five assembled diamonds.
Figure 12:
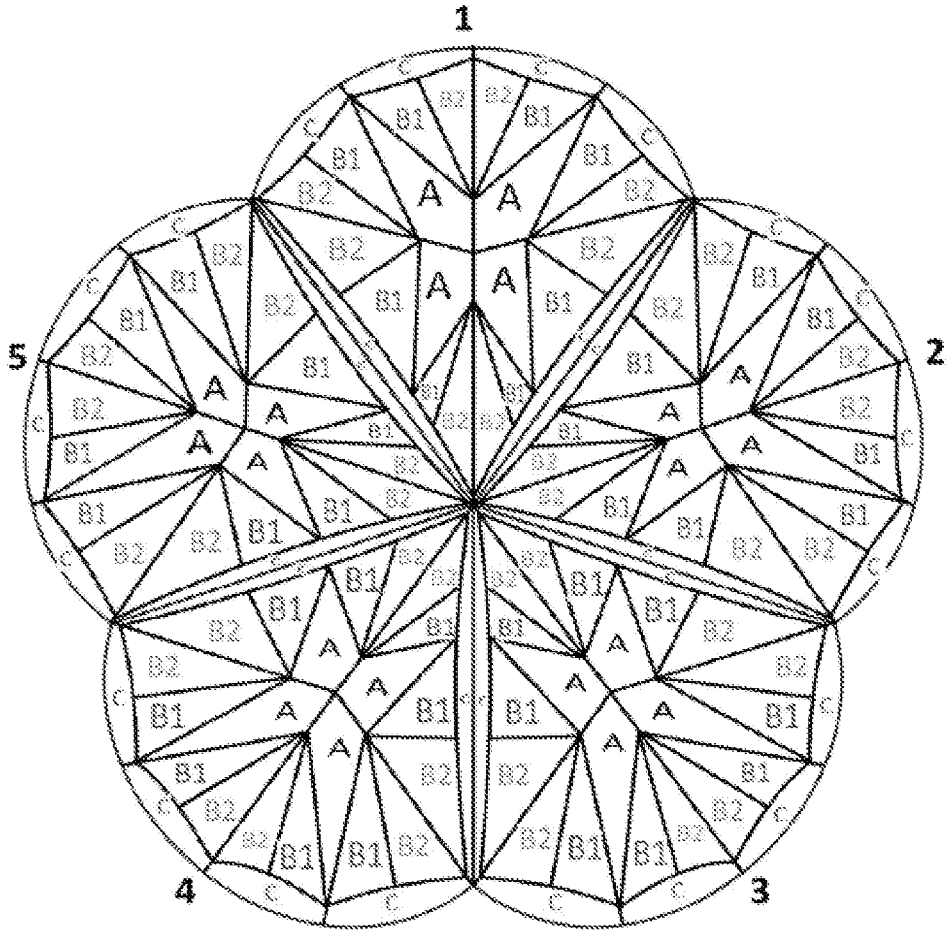
FIG. 12 shows bottom view of flower design with five assembled diamonds.
Figure 13:
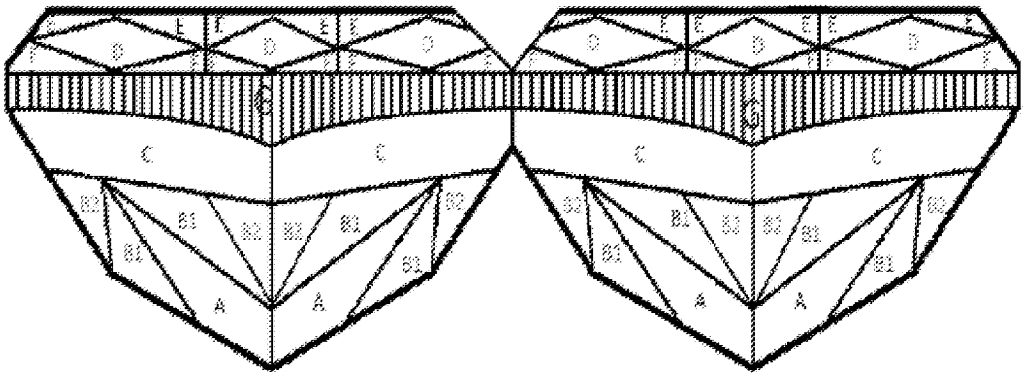
FIG. 13 shows side view of flower design with five assembled diamonds.

FIGS. 11-13 show the flower shaped composite diamond prepared from five diamonds. Below Table 4 shows specification of it.

TABLE 4

| 1 | | 2 | | 3 | | 4 | | 5 | |
|---|---|---|---|---|---|---|---|---|---|
| A | 28° TO 30° | A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° | C | 55° TO 60° |
| D | 28° TO 31° | D | 28° TO 31° | D | 28° TO 31° | D | 28° TO 31° | D | 28° TO 31° |
| E | 20° TO 25° | E | 20° TO 25° | E | 20° TO 25° | E | 20° TO 25° | E | 20° TO 25° |
| F | 32° TO 35° | F | 32° TO 35° | F | 32° TO 35° | F | 32° TO 35° | F | 32° TO 35° |
| G | 90° | G | 90° | G | 90° | G | 90° | G | 90° |

TABLE 4-continued

| 1 | | 2 | | 3 | | 4 | | 5 | |
|---|---|---|---|---|---|---|---|---|---|
| CROWN HEIGHT | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 42% TO 46% | PAVILION HEIGHT | 42% TO 46% | PAVILION HEIGHT | 42% TO 46% | PAVILION HEIGHT | 42% TO 46% | PAVILION HEIGHT | 42% TO 46% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 1.20 TO 1.25 | L/W RATIO | 1.20 TO 1.25 | L/W RATIO | 1.20 TO 1.25 | L/W RATIO | 1.20 TO 1.25 | L/W RATIO | 1.20 TO 1.25 |
| TOTAL DEPTH | 55% TO 60% | TOTAL DEPTH | 55% TO 60% | TOTAL DEPTH | 55% TO 60% | TOTAL DEPTH | 55% TO 60% | TOTAL DEPTH | 55% TO 60% |

Figure 14:
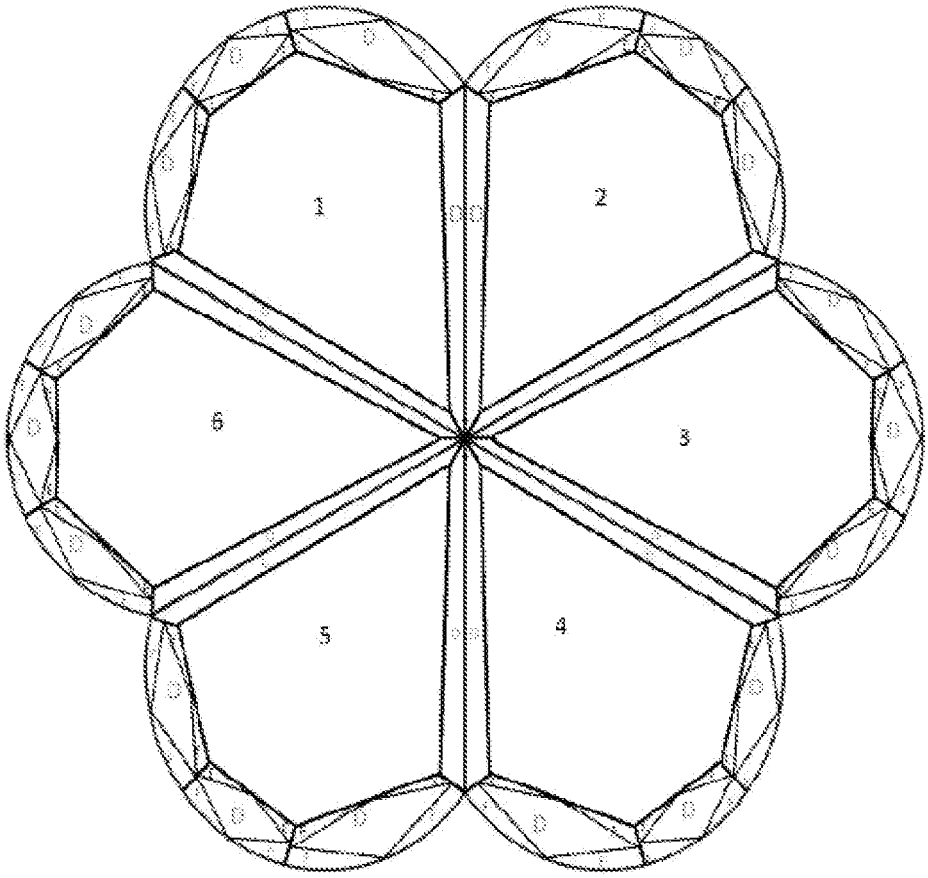
FIG. 14 shows top view of flower design with six assembled diamonds.
Figure 15:
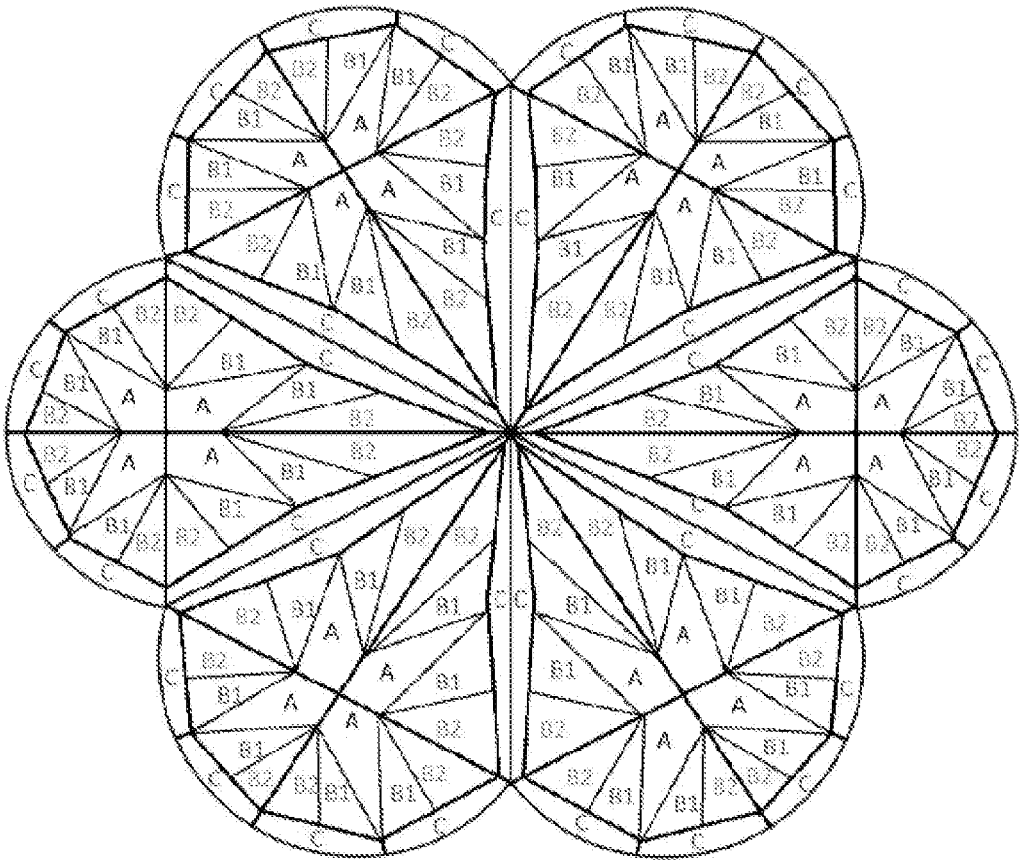
FIG. 15 shows bottom view of flower design with six assembled diamonds.
Figure 16:
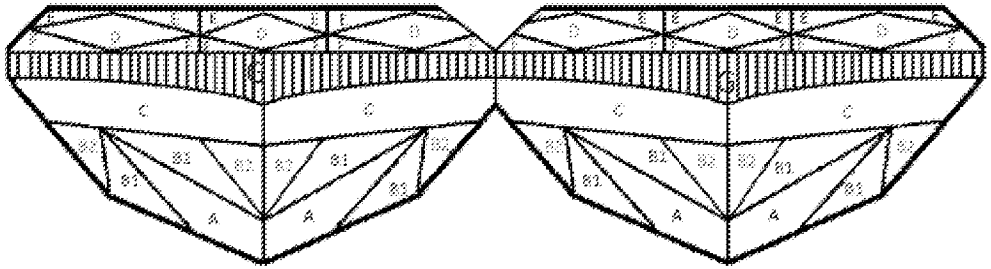
FIG. 16 shows side view of flower design with six assembled diamonds.

FIG. 14-16 shows the flower shaped composite diamond prepared from five diamonds. Below Table 5 shows specification of it.

TABLE 5

| 1 | | 2 | | 3 | |
|---|---|---|---|---|---|
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 42% TO 46% | PAVILION HEIGHT | 42% TO 46% | PAVILION HEIGHT | 42% TO 46% |
| GIRDLE THICKNESS | 10% TO 15% | GIRDLE THICKNESS | 10% TO 15% | GIRDLE THICKNESS | 10% TO 15% |
| L/W RATIO | 1.25 TO 1.23 | L/W RATIO | 1.25 TO 1.23 | L/W RATIO | 1.25 TO 1.23 |
| TOTAL DEPTH | 55% TO 60% | TOTAL DEPTH | 55% TO 60% | TOTAL DEPTH | 55% TO 60% |
| 4 | | 5 | | 6 | |
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 42% TO 46% | PAVILION HEIGHT | 42% TO 46% | PAVILION HEIGHT | 42% TO 46% |
| GIRDLE THICKNESS | 10% TO 15% | GIRDLE THICKNESS | 10% TO 15% | GIRDLE THICKNESS | 10% TO 15% |
| L/W RATIO | 1.25 TO 1.23 | L/W RATIO | 1.25 TO 1.23 | L/W RATIO | 1.25 TO 1.23 |
| TOTAL DEPTH | 55% TO 60% | TOTAL DEPTH | 55% TO 60% | TOTAL DEPTH | 55% TO 60% |

Figure 17:
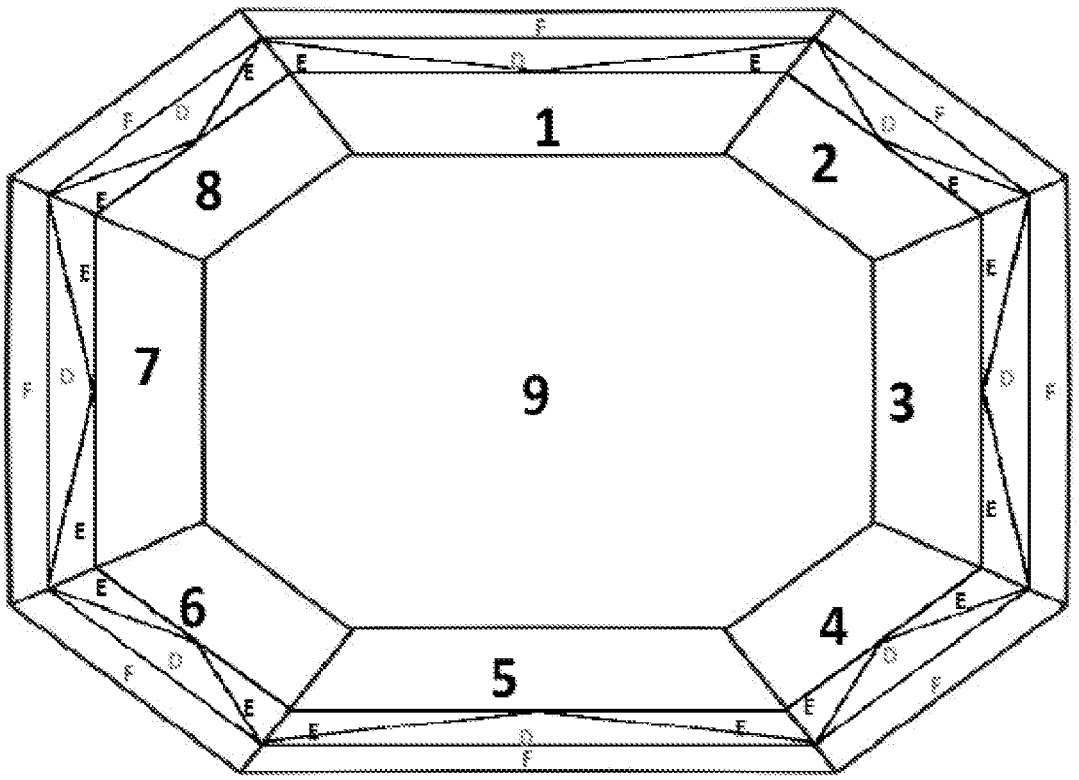
FIG. 17 shows top view of rectangular design with nine assembled diamonds.
Figure 18:
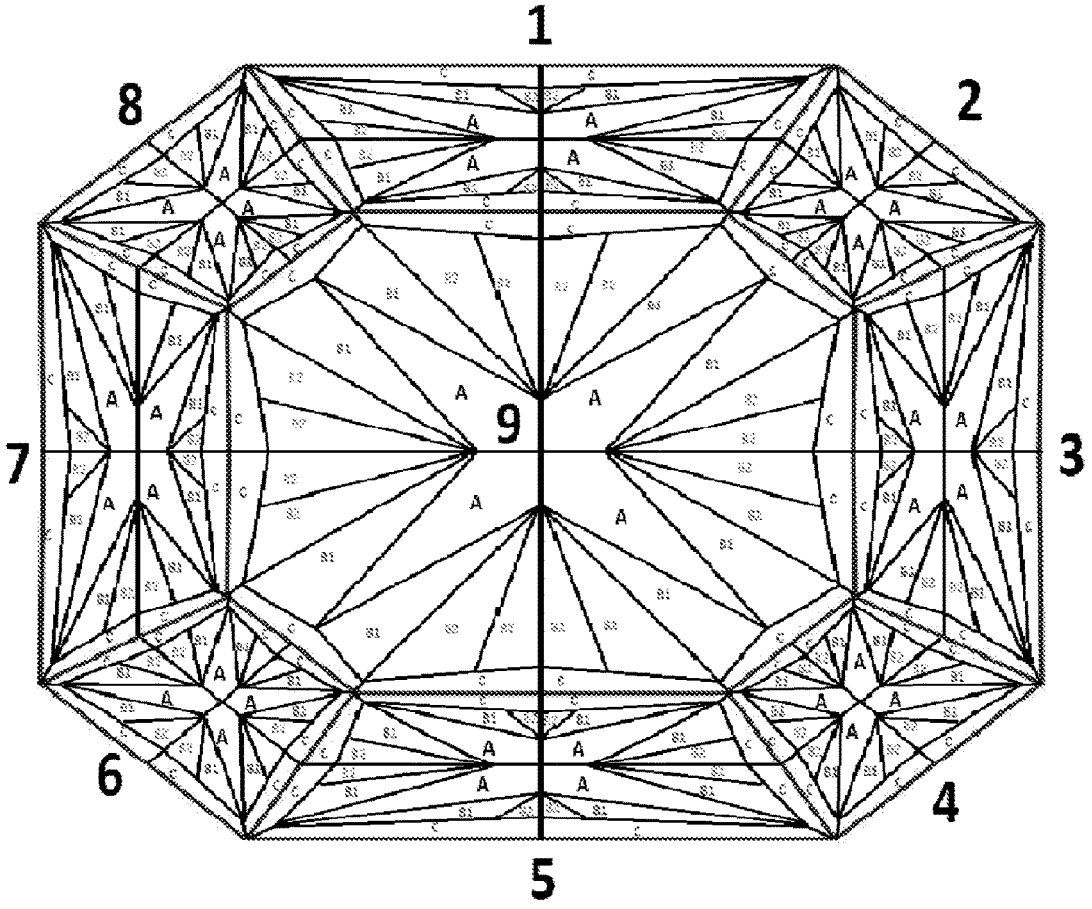
FIG. 18 shows bottom view of rectangular design with nine assembled diamonds.
Figure 19:
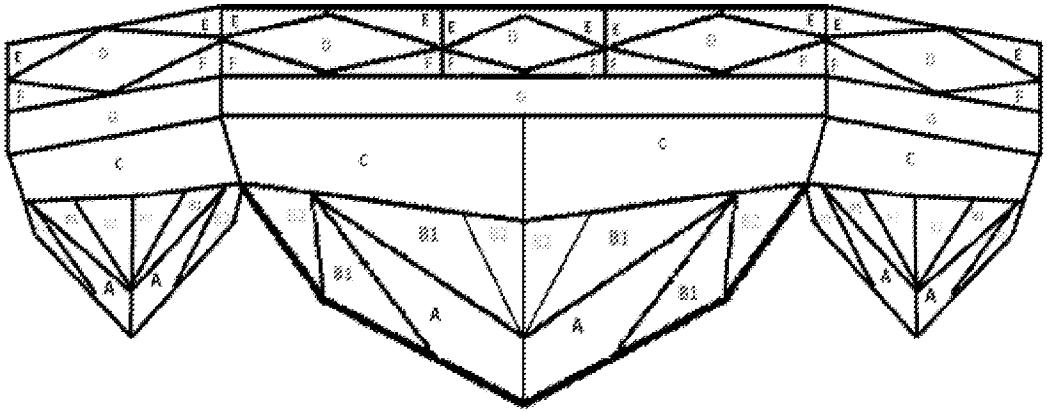
FIG. 19 shows side view of rectangular design with nine assembled diamonds.

FIGS. 17-19 show the rectangular shaped composite diamond prepared from nine diamonds. Below Table 6 shows specification of it.

TABLE 6

| 1 | | 2 | | 3 | | 4 | | 5 | |
|---|---|---|---|---|---|---|---|---|---|
| A | 28° TO 30° | A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° | C | 55° TO 60° |
| D | 28° TO 31° | D | 28° TO 31° | D | 28° TO 31° | D | 28° TO 31° | D | 28° TO 31° |
| E | 20° TO 25° | E | 20° TO 25° | E | 20° TO 25° | E | 20° TO 25° | E | 20° TO 25° |

TABLE 6-continued

| | | | | | | | | | |
|---|---|---|---|---|---|---|---|---|---|
| F | 32° TO 35° | F | 32° TO 35° | F | 32° TO 35° | F | 32° TO 35° | F | 32° TO 35° |
| G | 90° | G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.30 TO 0.35 | L/W RATIO | 0.80 TO 0.85 | L/W RATIO | 0.40 TO 0.45 | L/W RATIO | 0.80 TO 0.85 | L/W RATIO | 0.30 TO 0.35 |
| TOTAL DEPTH | 55% TO 60% | TOTAL DEPTH | 55% TO 60% | TOTAL DEPTH | 55% TO 60% | TOTAL DEPTH | 55% TO 60% | TOTAL DEPTH | 55% TO 60% |

| 6 | | 7 | | 8 | | 9 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | — |
| E | 20° TO 25° | E | 20° TO 25° | E | 20° TO 25° | E | — |
| F | 32° TO 35° | F | 32° TO 35° | F | 32° TO 35° | F | — |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | — |
| PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.80 TO 0.85 | L/W RATIO | 0.40 TO 0.45 | L/W RATIO | 0.80 TO 0.85 | L/W RATIO | 1.20 TO 1.30 |
| TOTAL DEPTH | 55% TO 60% | TOTAL DEPTH | 55% TO 60% | TOTAL DEPTH | 55% TO 60% | TOTAL DEPTH | 55% TO 60% |

Figure 20:
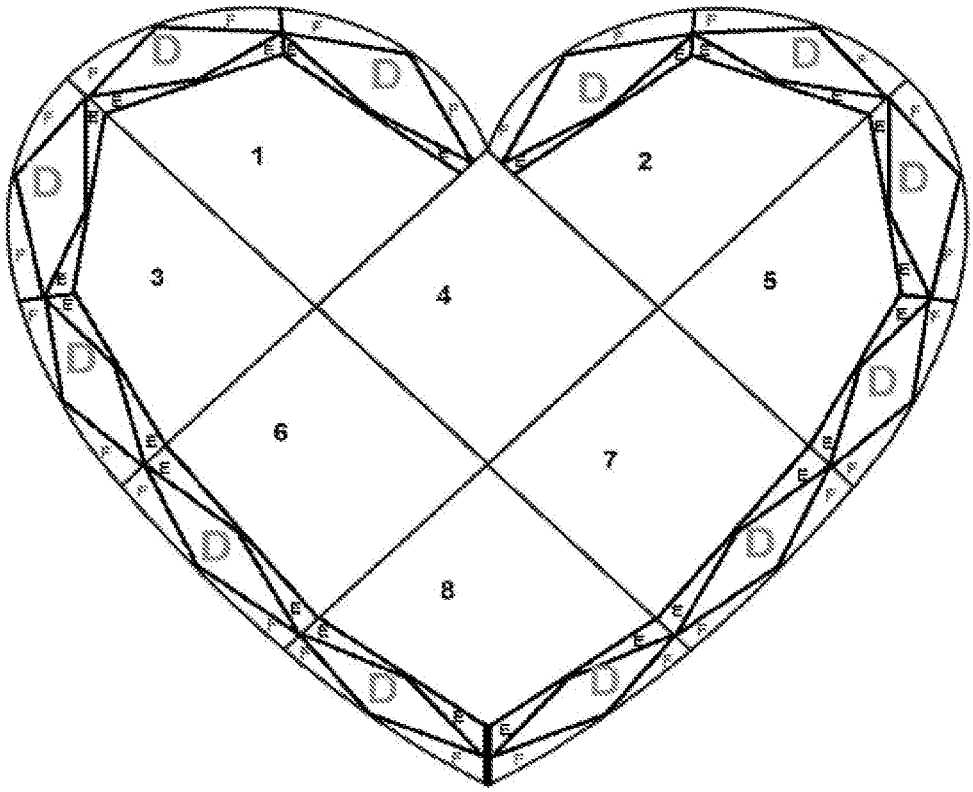
FIG. 20 shows top view of heart design with eight assembled diamonds.
Figure 21:
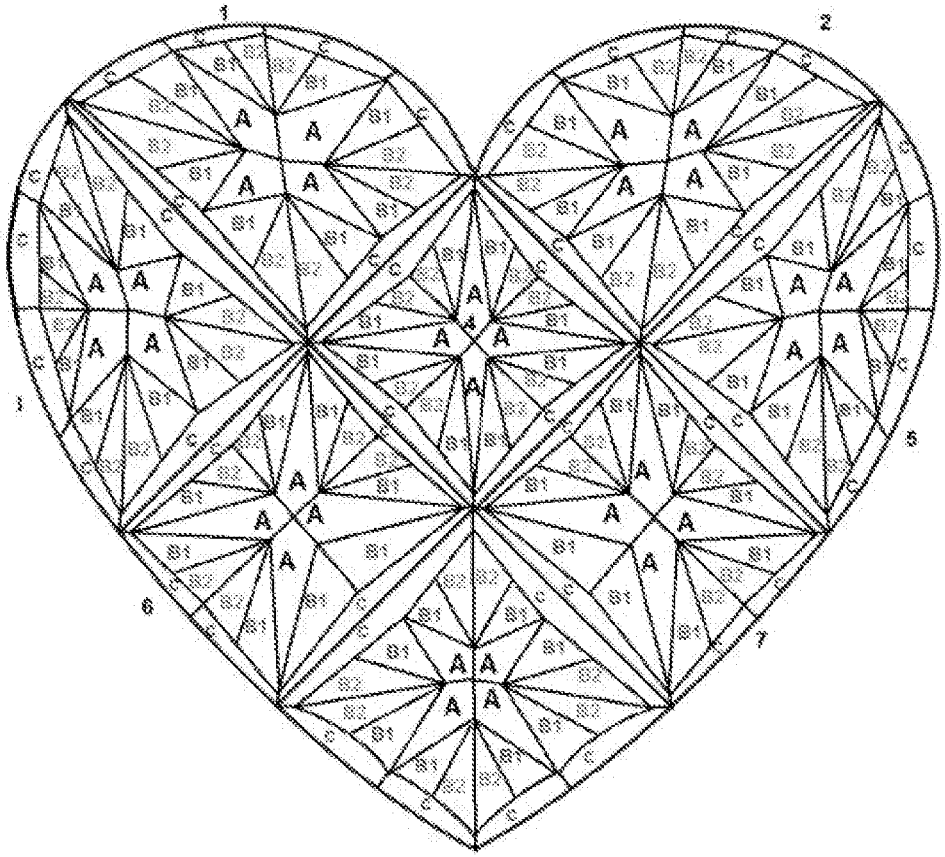
FIG. 21 shows bottom view of heart design with eight assembled diamonds.
Figure 22:
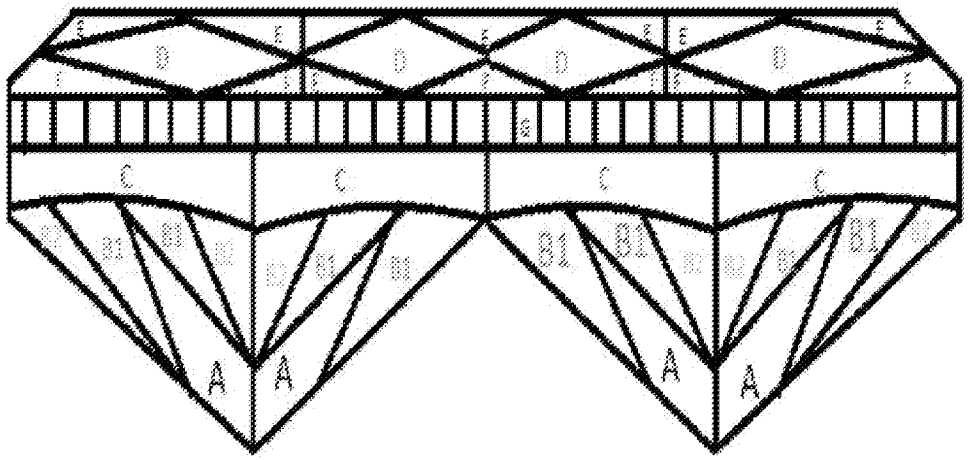
FIG. 22 shows side view of heart design with eight assembled diamonds.

FIG. 20-22 shows the heart shaped composite diamond prepared from eight diamonds. Below Table 7 shows specification of it.

TABLE 7

| 1 | | 2 | | 3 | | 4 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | 28° TO 31° |
| E | 20° TO 25° | E | 20° TO 25° | E | 20° TO 25° | E | 20° TO 25° |
| F | 32° TO 35° | F | 32° TO 35° | F | 32° TO 35° | F | 32° TO 35° |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.60 TO 0.65 | L/W RATIO | 0.60 TO 0.65 | L/W RATIO | 0.60 TO 0.65 | L/W RATIO | 1 |
| TOTAL DEPTH | 55% TO 60% | TOTAL DEPTH | 55% TO 60% | TOTAL DEPTH | 55% TO 60% | TOTAL DEPTH | 55% TO 60% |

| 5 | | 6 | | 7 | | 8 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | 28° TO 31° |
| E | 20° TO 25° | E | 20° TO 25° | E | 20° TO 25° | E | 20° TO 25° |
| F | 32° TO 35° | F | 32° TO 35° | F | 32° TO 35° | F | 32° TO 35° |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 42% TO 46% | PAVILION HEIGHT | 40% TO 45% | PAVILION HEIGHT | 42% TO 46% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |

TABLE 7-continued

| | | | | | | | |
|---|---|---|---|---|---|---|---|
| L/W RATIO | 0.60 TO 0.65 | L/W RATIO | 0.90 TO 0.95 | L/W RATIO | 0.90 TO 0.95 | L/W RATIO | 0.85 TO 0.95 |
| TOTAL DEPTH | 55% TO 60% | TOTAL DEPTH | 55% TO 60% | TOTAL DEPTH | 55% TO 60% | TOTAL DEPTH | 55% TO 60% |

Figure 23:
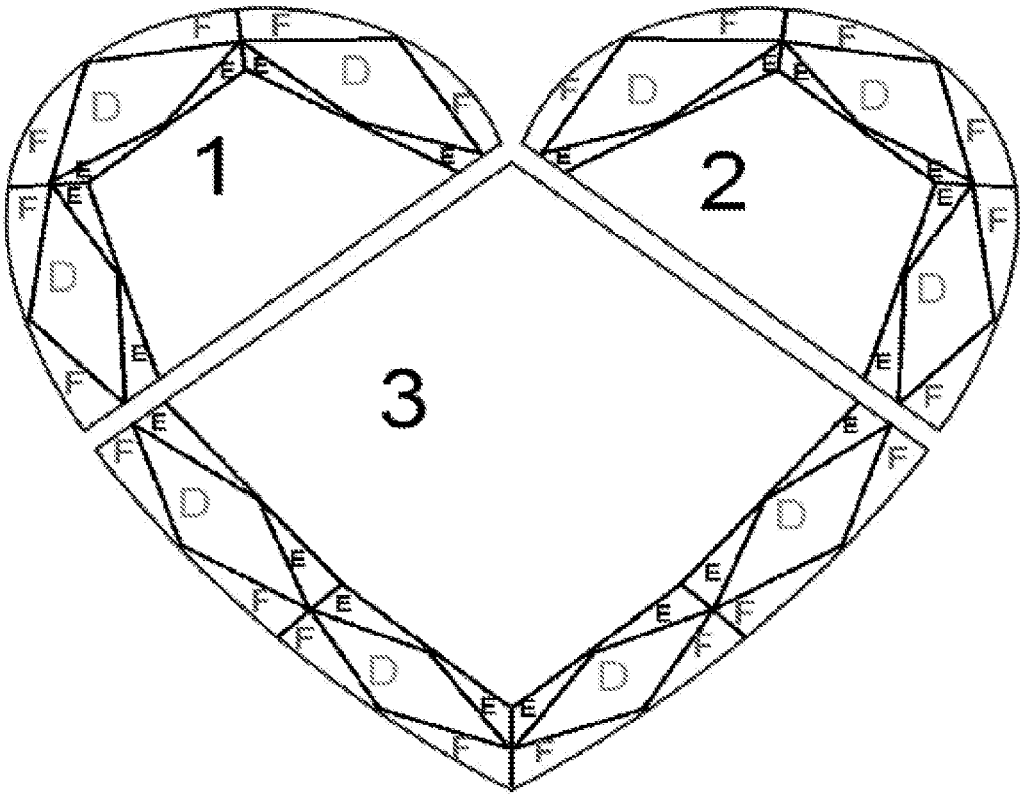
FIG. 23 shows top view of heart design with three assembled diamonds.
Figure 24:
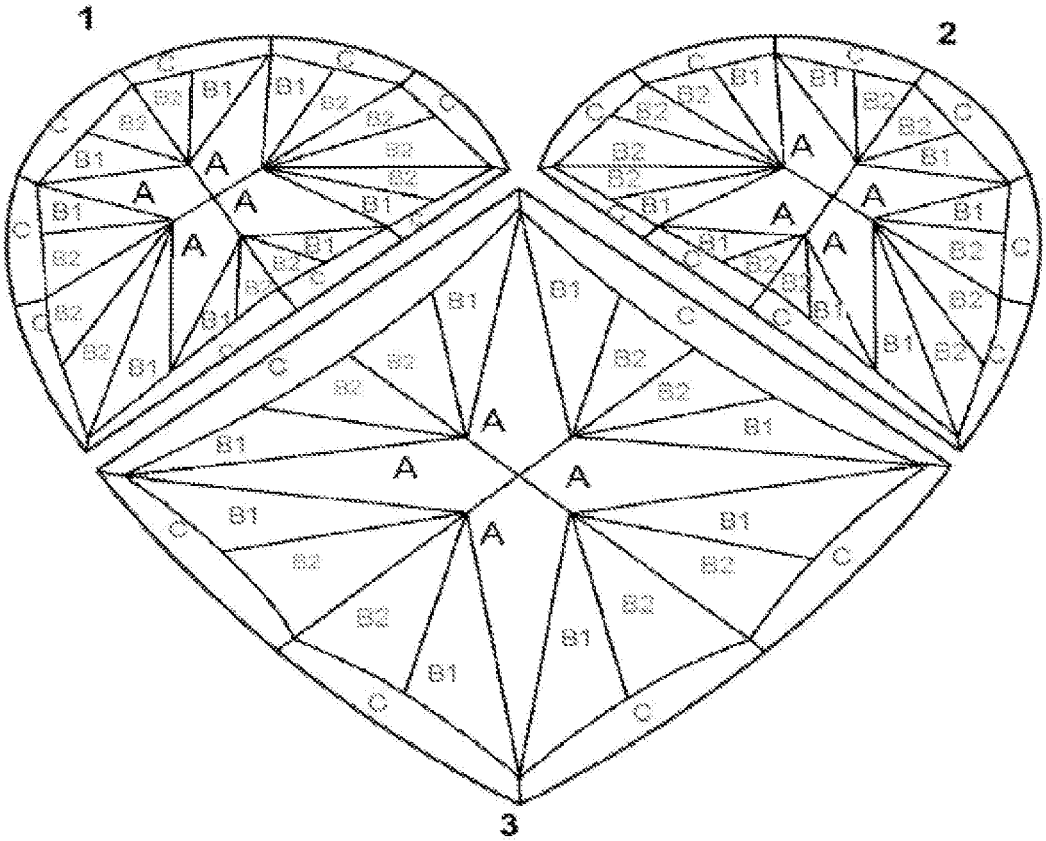
FIG. 24 shows bottom view of heart design with three assembled diamonds.
Figure 25:
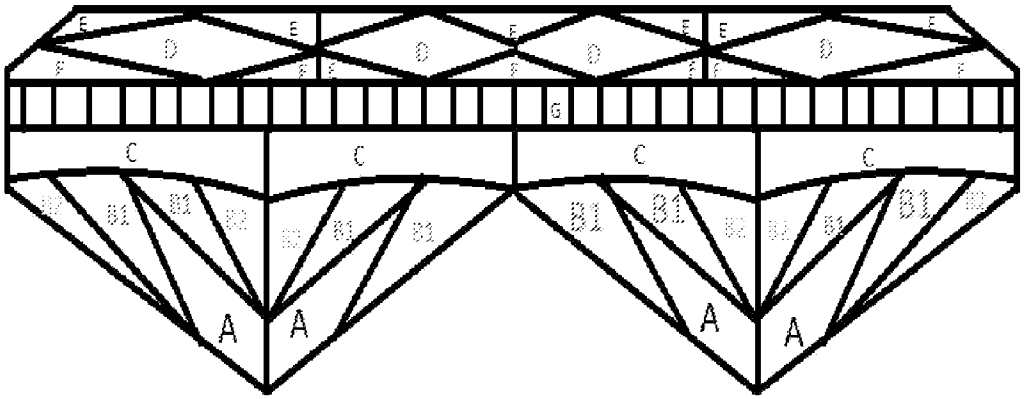
FIG. 25 shows side view of heart design with three assembled diamonds.

FIGS. 23-25 show the heart shaped composite diamond prepared from three diamonds. Below Table 8 shows specification of it.

TABLE 8

| 1 | | 2 | | 3 | |
|---|---|---|---|---|---|
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 42% TO 46% |
| GIRDLE THICKNESS | 10% TO 15% | GIRDLE THICKNESS | 10% TO 15% | GIRDLE THICKNESS | 10% TO 15% |
| L/W RATIO | 0.60 TO 0.70 | L/W RATIO | 0.60 TO 0.70 | L/W RATIO | 0.80 TO 0.90 |
| TOTAL DEPTH | 55% TO 60% | TOTAL DEPTH | 55% TO 60% | TOTAL DEPTH | 55% TO 60% |

Figure 26:
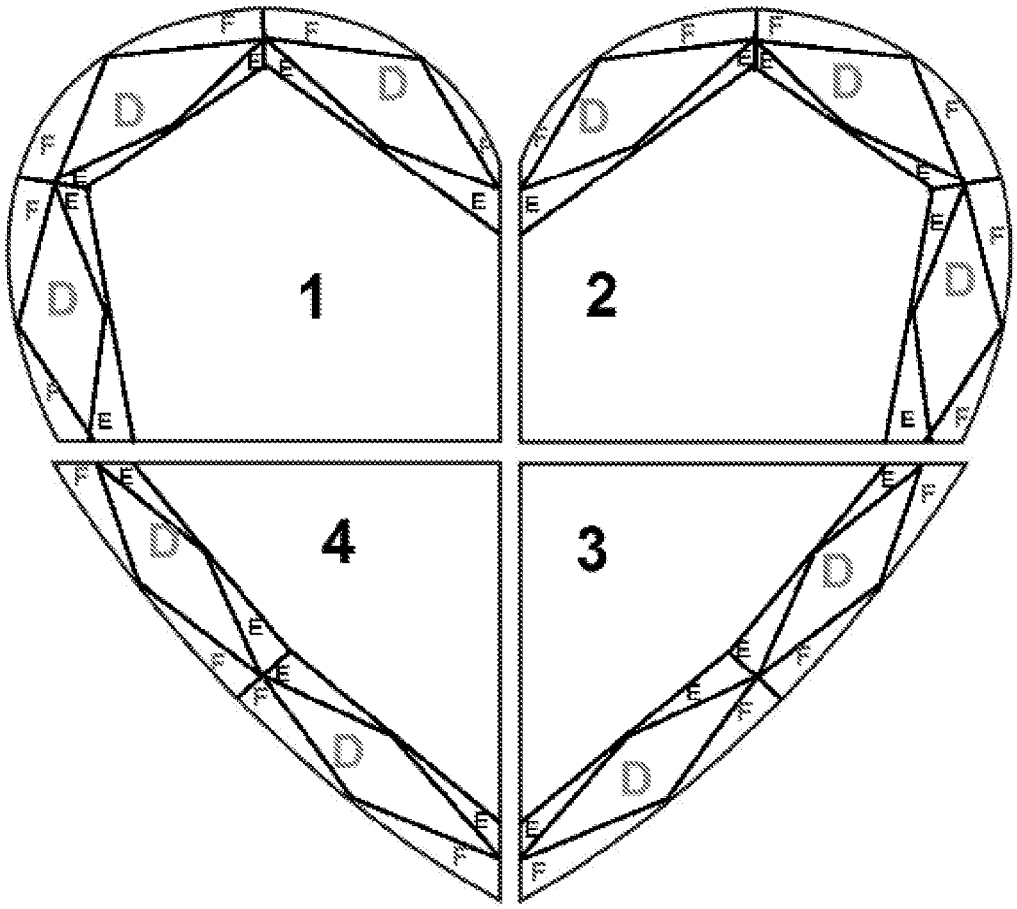
FIG. 26 shows top view of heart design with four assembled diamonds.
Figure 27:
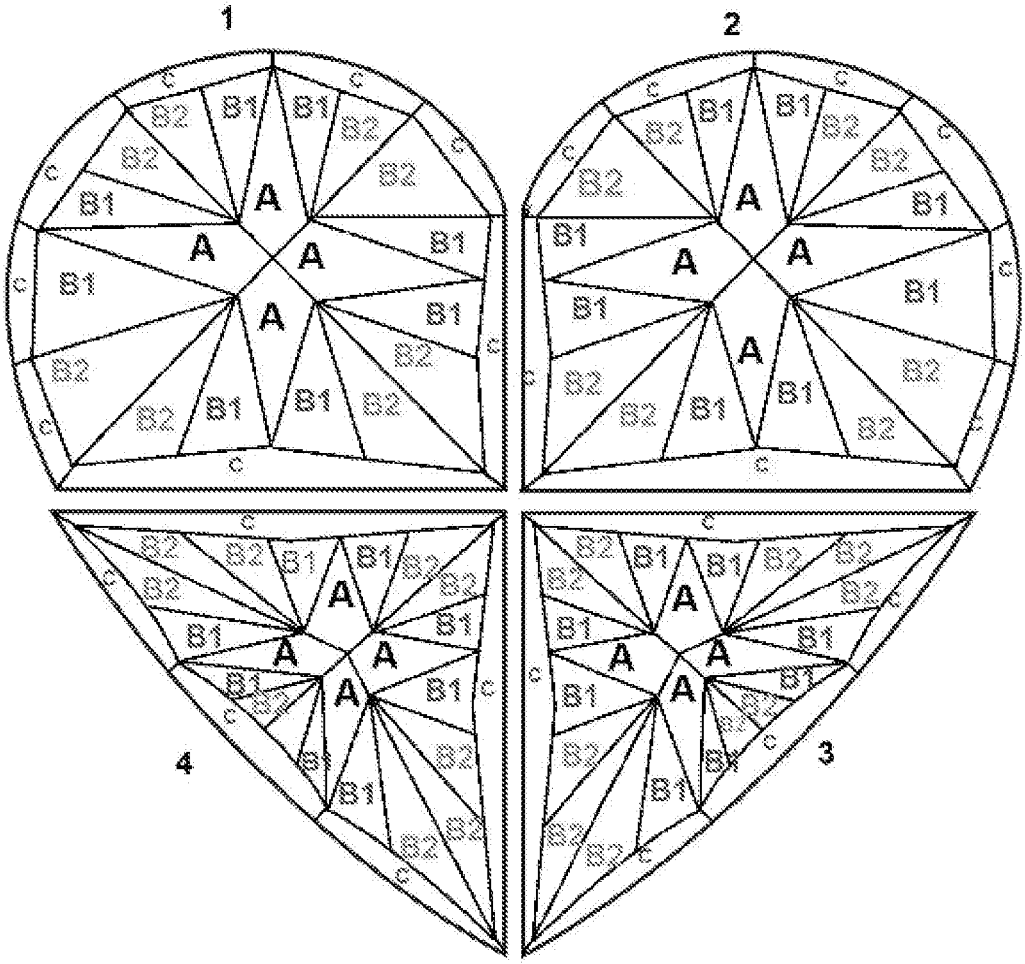
FIG. 27 shows bottom view of heart design with four assembled diamonds.
Figure 28:
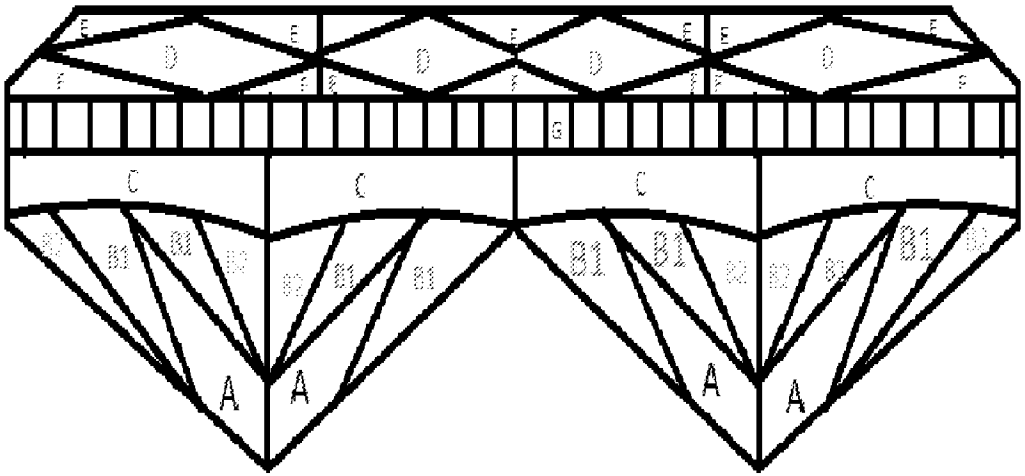
FIG. 28 shows side view of heart design with four assembled diamonds.

FIGS. 26-28 show the heart shaped composite diamond prepared from four diamonds. Below Table 9 shows specification of it.

TABLE 9

| 1 | | 2 | | 3 | | 4 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | 28° TO 31° |
| E | 20° TO 25° | E | 20° TO 25° | E | 20° TO 25° | E | 20° TO 25° |
| F | 32° TO 35° | F | 32° TO 35° | F | 32° TO 35° | F | 32° TO 35° |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 42% TO 46% | PAVILION HEIGHT | 42% TO 46% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.70 TO 0.80 | L/W RATIO | 0.70 TO 0.80 | L/W RATIO | 0.60 TO 0.70 | L/W RATIO | 0.60 TO 0.70 |
| TOTAL DEPTH | 55% TO 60% | TOTAL DEPTH | 55% TO 60% | TOTAL DEPTH | 55% TO 60% | TOTAL DEPTH | 55% TO 60% |

Figure 29:
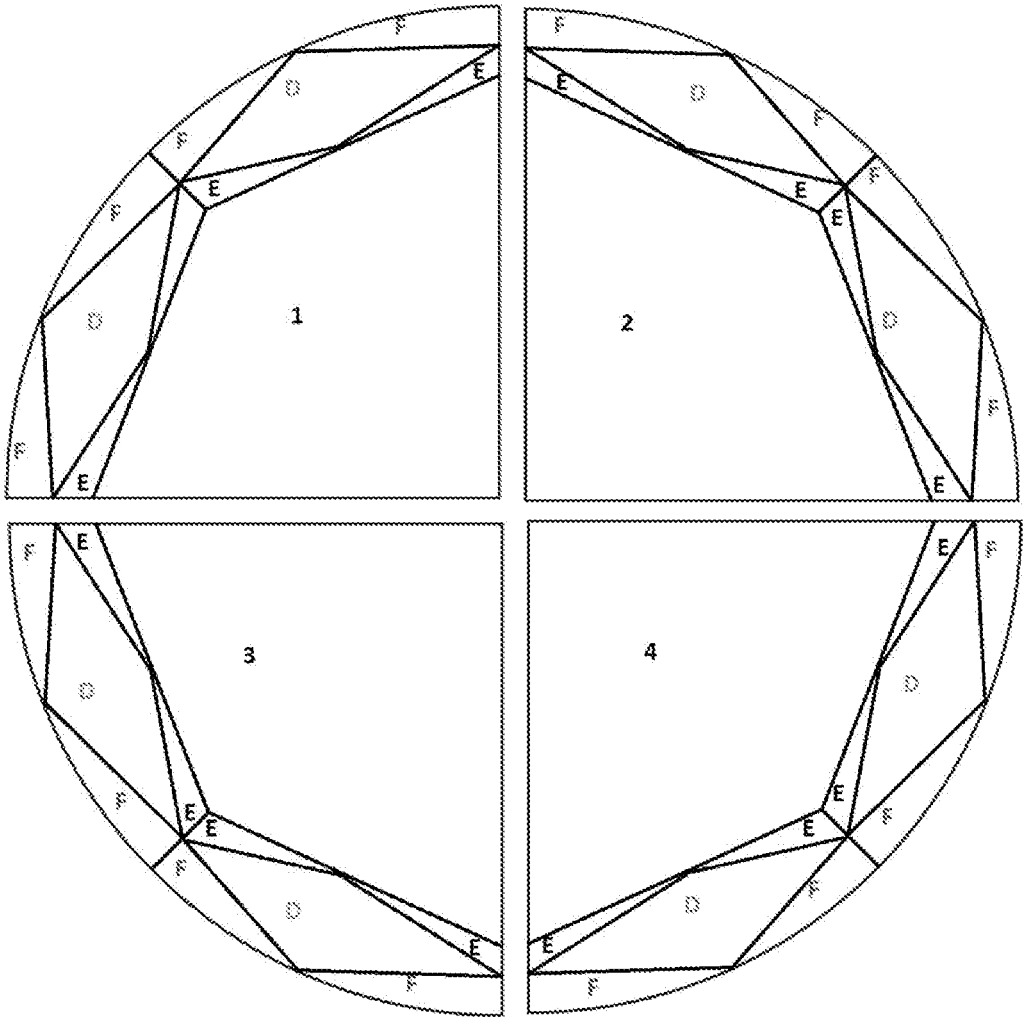
FIG. 29 shows side view of round design with four assembled diamonds.
Figure 30:
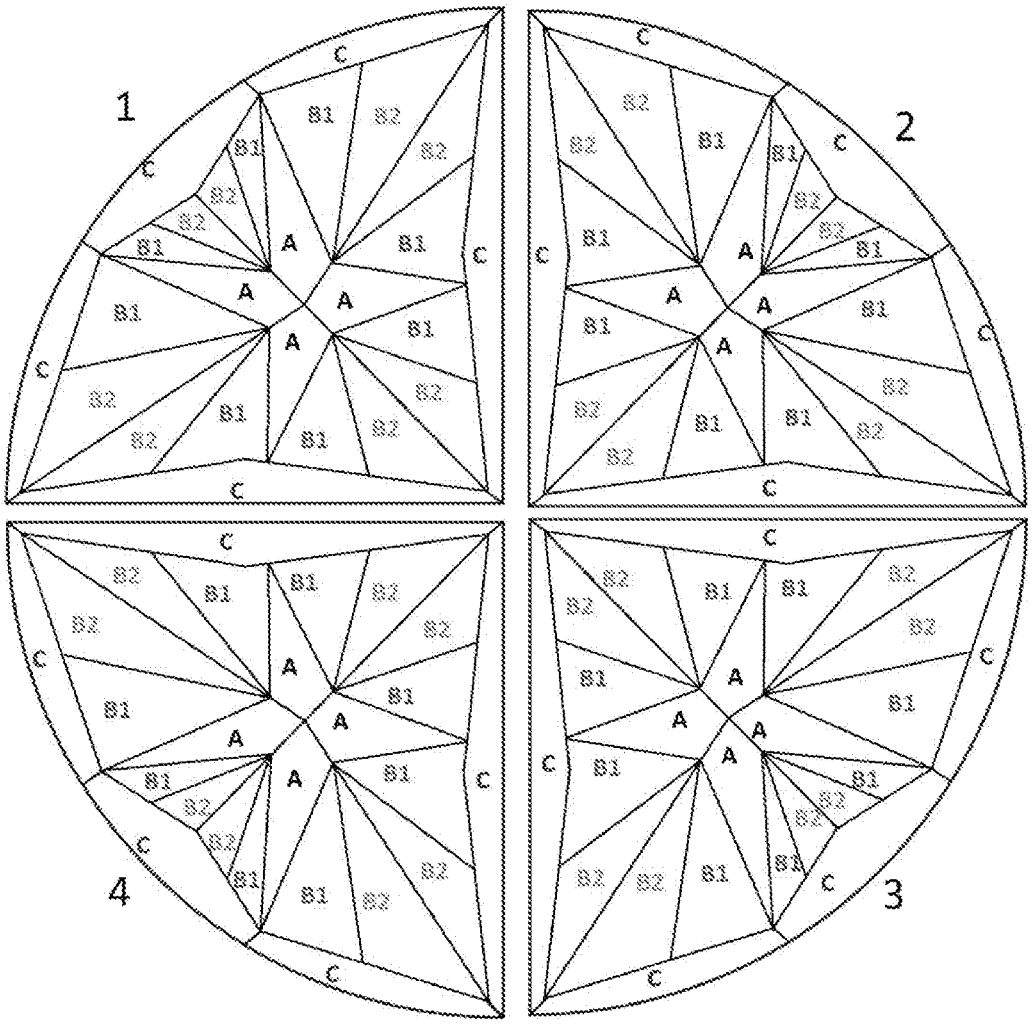
FIG. 30 shows side view of round design with four assembled diamonds.
Figure 31:
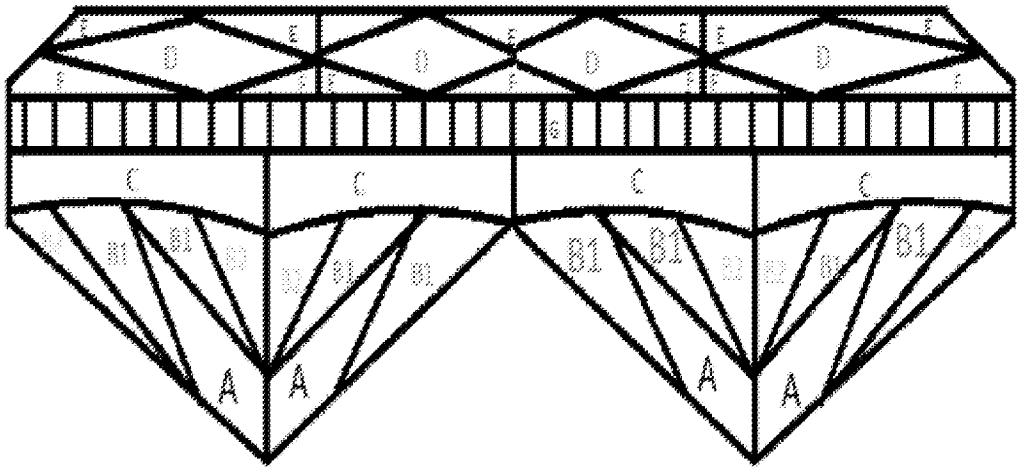
FIG. 31 shows side view of round design with four assembled diamonds.

FIGS. 29-31 show the round shaped composite diamond prepared from four diamonds. Below Table 10 shows specification of it.

TABLE 10

| 1 | | 2 | | 3 | | 4 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |

TABLE 10-continued

| 1 | | 2 | | 3 | | 4 | |
|---|---|---|---|---|---|---|---|
| D | 28° TO 30° | D | 28° TO 30° | D | 28° TO 30° | D | 28° TO 30° |
| E | 20° TO 25° | E | 20° TO 25° | E | 20° TO 25° | E | 20° TO 25° |
| F | 32° TO 35° | F | 32° TO 35° | F | 32° TO 35° | F | 32° TO 35° |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 30% TO 35% | PAVILION HEIGHT | 30% TO 35% | PAVILION HEIGHT | 30% TO 35% | PAVILION HEIGHT | 30% TO 35% |
| GIRDLE THICKNESS | 15% TO 18% | GIRDLE THICKNESS | 15% TO 18% | GIRDLE THICKNESS | 15% TO 18% | GIRDLE THICKNESS | 15% TO 18% |
| L/W RATIO | 72 | L/W RATIO | 72 | L/W RATIO | 72 | L/W RATIO | 72 |
| TOTAL DEPTH | 45% TO 50% | TOTAL DEPTH | 45% TO 50% | TOTAL DEPTH | 45% TO 50% | TOTAL DEPTH | 45% TO 50% |

Figure 32:
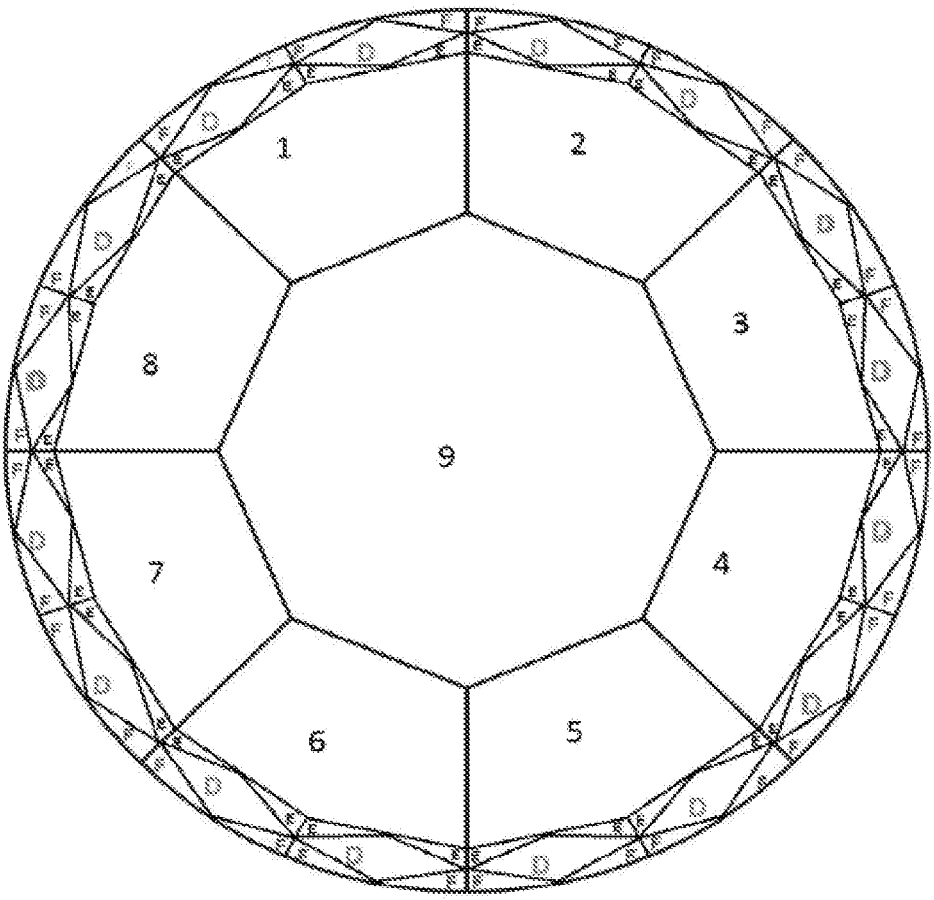
FIG. 32 shows top view of round design with nine assembled diamonds.
Figure 33:
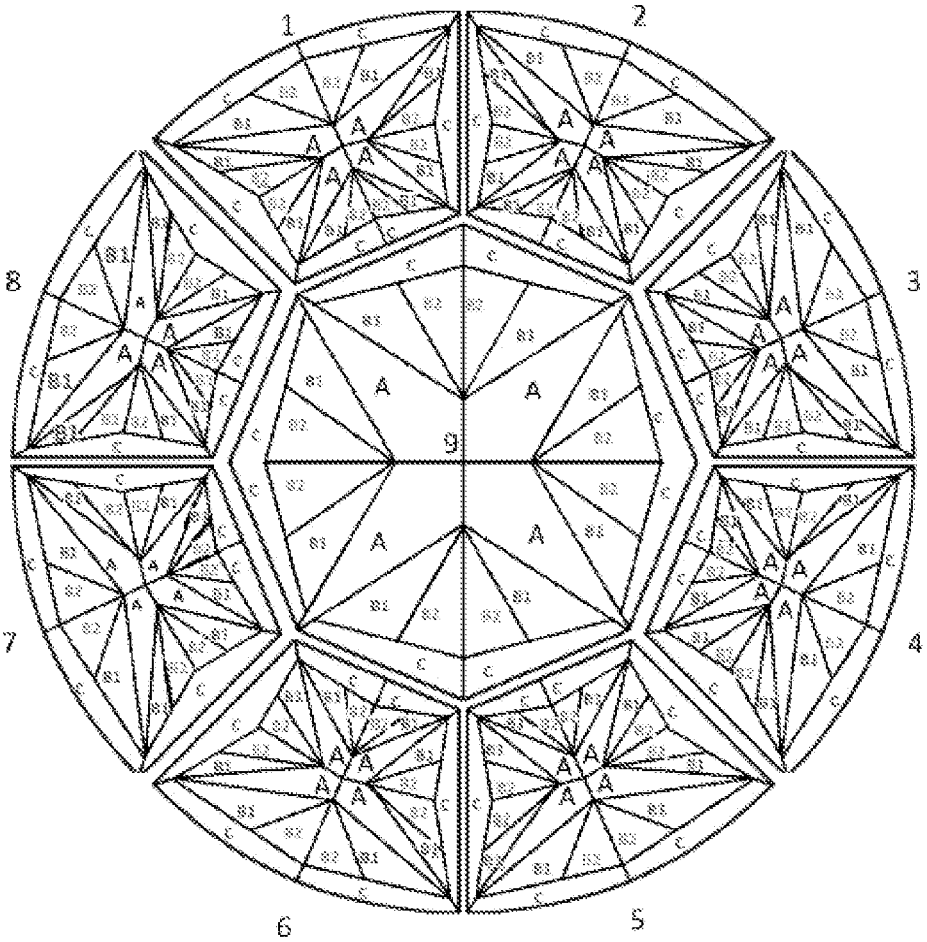
FIG. 33 shows bottom view of round design with nine assembled diamonds.
Figure 34:
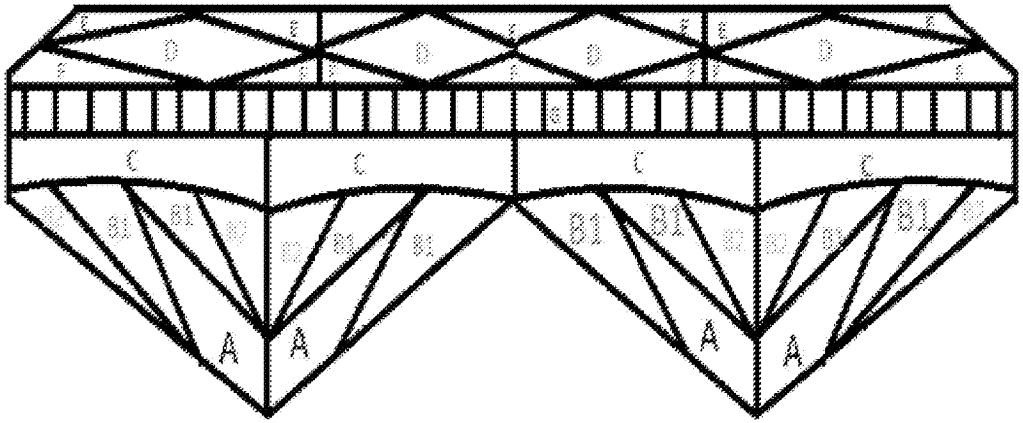
FIG. 34 shows side view of round design with nine assembled diamonds.

FIGS. 32-34 show the round shaped composite diamond prepared from nine diamonds. Below Table 11 shows specification of it.

TABLE 11

| 1 | | 2 | | 3 | | 4 | | 5 | |
|---|---|---|---|---|---|---|---|---|---|
| A | 28° TO 30° | A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° | C | 55° TO 60° |
| D | 28° TO 31° | D | 28° TO 31° | D | 28° TO 31° | D | 28° TO 31° | D | 28° TO 31° |
| E | 20° TO 25° | E | 20° TO 25° | E | 20° TO 25° | E | 20° TO 25° | E | 20° TO 25° |
| F | 32° TO 35° | F | 32° TO 35° | F | 32° TO 35° | F | 32° TO 35° | F | 32° TO 35° |
| G | 90° | G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.65 TO 0.70 | L/W RATIO | 0.65 TO 0.70 | L/W RATIO | 0.65 TO 0.70 | L/W RATIO | 0.65 TO 0.70 | L/W RATIO | 0.65 TO 0.70 |
| TOTAL DEPTH | 55% TO 60% | TOTAL DEPTH | 55% TO 60% | TOTAL DEPTH | 55% TO 60% | TOTAL DEPTH | 55% TO 60% | TOTAL DEPTH | 55% TO 60% |

| 6 | | 7 | | 8 | | 9 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | — |
| E | 20° TO 25° | E | 20° TO 25° | E | 20° TO 25° | E | — |
| F | 32° TO 35° | F | 32° TO 35° | F | 32° TO 35° | F | — |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | — |
| PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.65 TO 0.70 | L/W RATIO | 0.65 TO 0.70 | L/W RATIO | 0.65 TO 0.70 | L/W RATIO | 1.00 |
| TOTAL DEPTH | 55% TO 60% | TOTAL DEPTH | 55% TO 60% | TOTAL DEPTH | 55% TO 60% | TOTAL DEPTH | 55% TO 60% |

Figure 35:
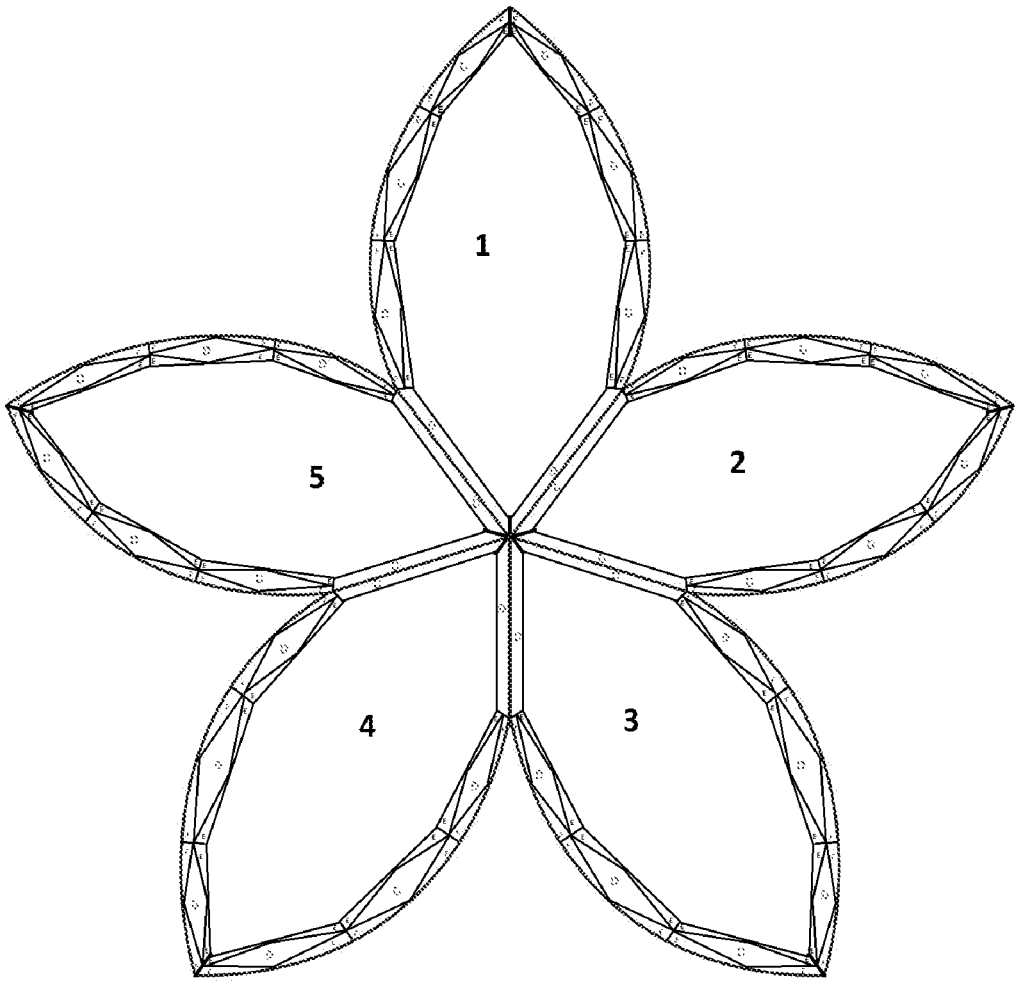
FIG. 35 shows top view of marquise star flower design with five assembled diamonds.
Figure 36:
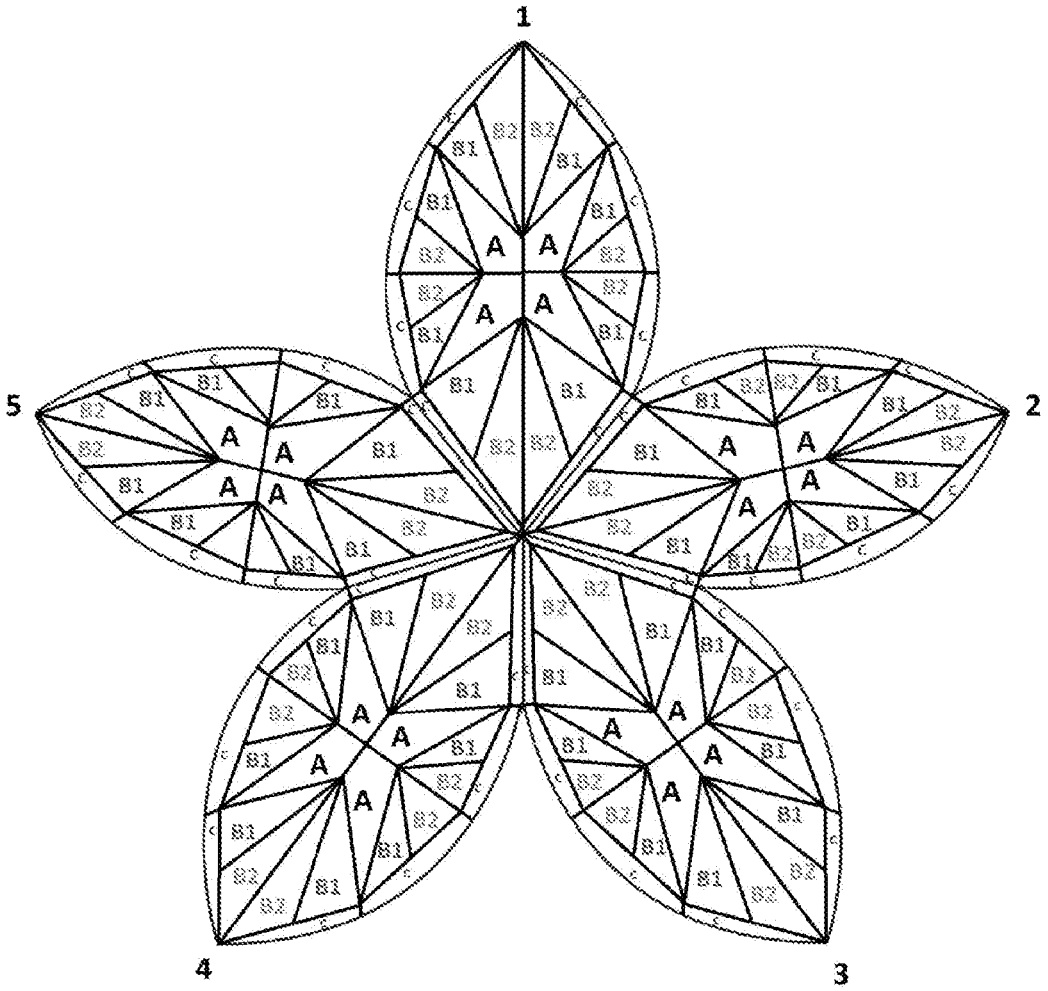
FIG. 36 shows bottom view of marquise star flower design with five assembled diamonds.
Figure 37:
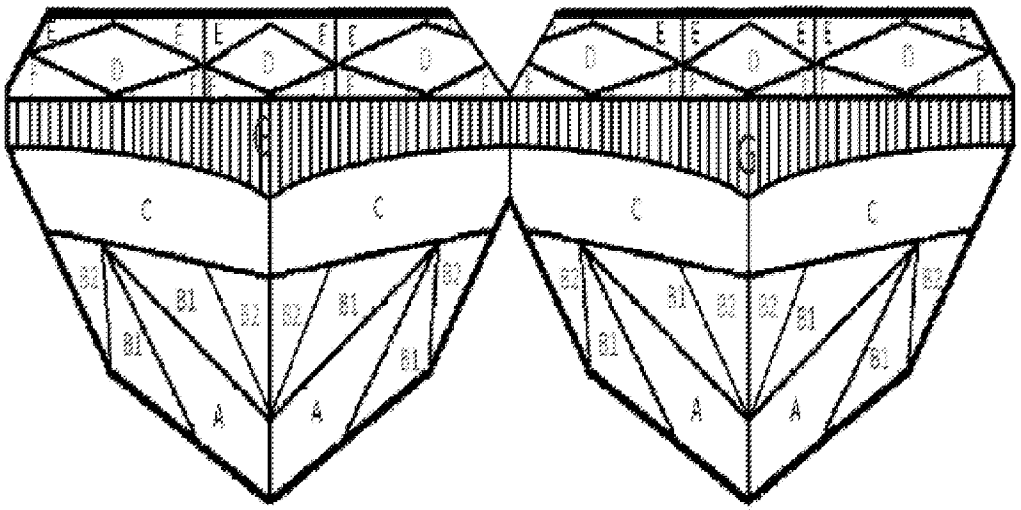
FIG. 37 shows side view of marquise star flower design with five assembled diamonds.

FIGS. 35-37 show the marquise star shaped composite diamond prepared from five diamonds. Below Table 12 shows specification of it.

TABLE 12

| 1 | | 2 | | 3 | | 4 | | 5 | |
|---|---|---|---|---|---|---|---|---|---|
| A | 28° TO 30° | A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° | C | 55° TO 60° |
| D | 28° TO 31° | D | 28° TO 31° | D | 28° TO 31° | D | 28° TO 31° | D | 28° TO 31° |
| E | 20° TO 25° | E | 20° TO 25° | E | 20° TO 25° | E | 20° TO 25° | E | 20° TO 25° |
| F | 32° TO 35° | F | 32° TO 35° | F | 32° TO 35° | F | 32° TO 35° | F | 32° TO 35° |
| G | 90° | G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICK-NESS | 10% TO 15% | GIRDLE THICKNESS | 10% TO 15% | GIRDLE THICK-NESS | 10% TO 15% | GIRDLE THICKNESS | 10% TO 15% |
| L/W RATIO | 1.80 TO 2.00 | L/W RATIO | 1.80 TO 2.00 | L/W RATIO | 1.80 TO 2.00 | L/W RATIO | 1.80 TO 2.00 | L/W RATIO | 1.80 TO 2.00 |
| TOTAL DEPTH | 55% TO 60% | TOTAL DEPTH | 55% TO 60% | TOTAL DEPTH | 55% TO 60% | TOTAL DEPTH | 55% TO 60% | TOTAL DEPTH | 55% TO 60% |

Figure 38:
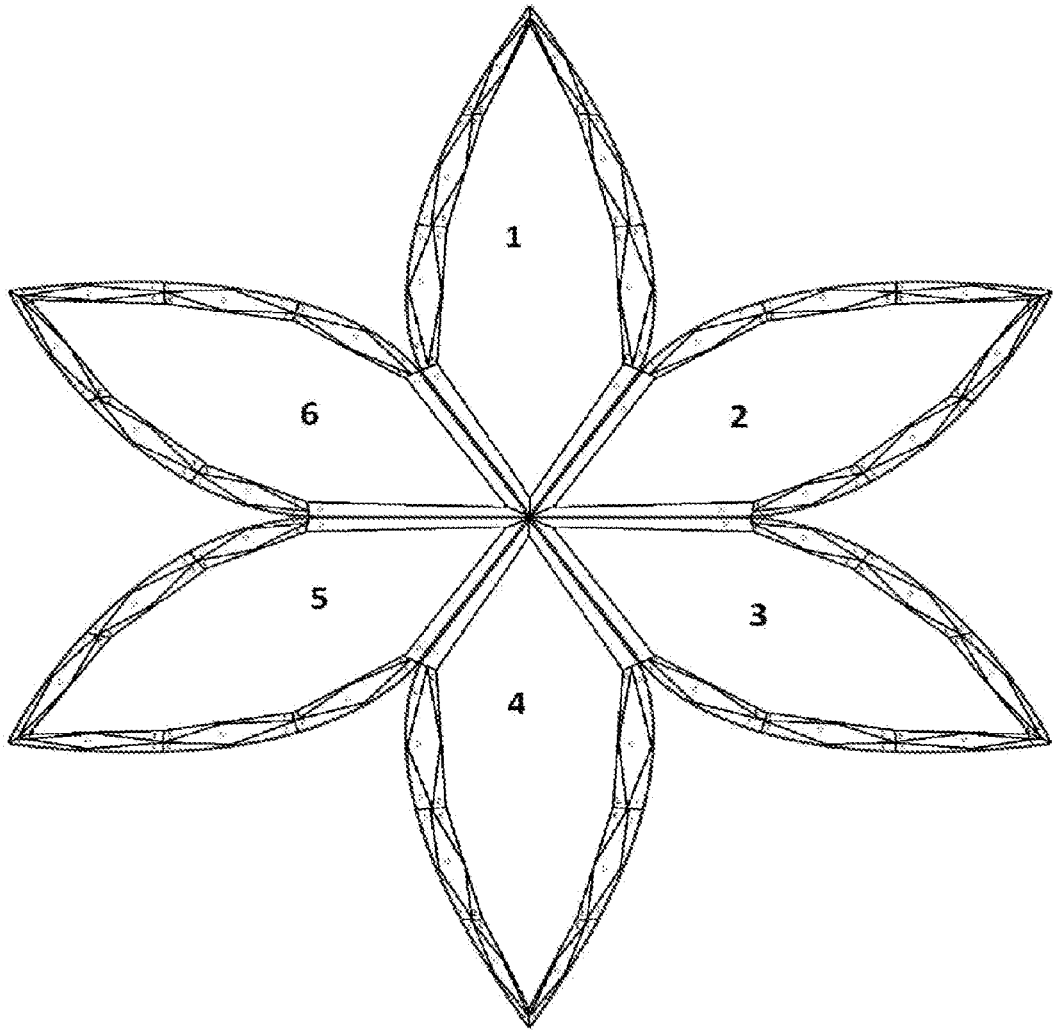
FIG. 38 shows top view of marquise star flower design with six assembled diamonds.
Figure 39:
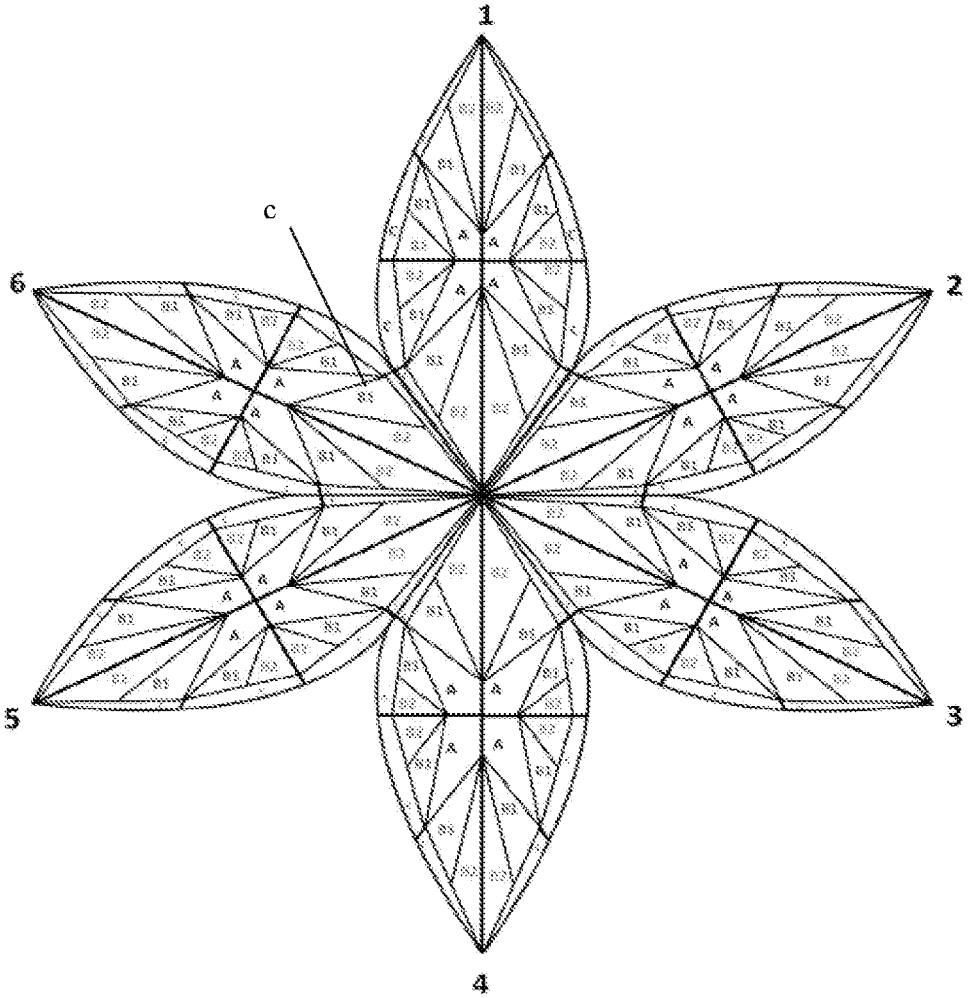
FIG. 39 shows bottom view of marquise star flower design with six assembled diamonds.
Figure 40:
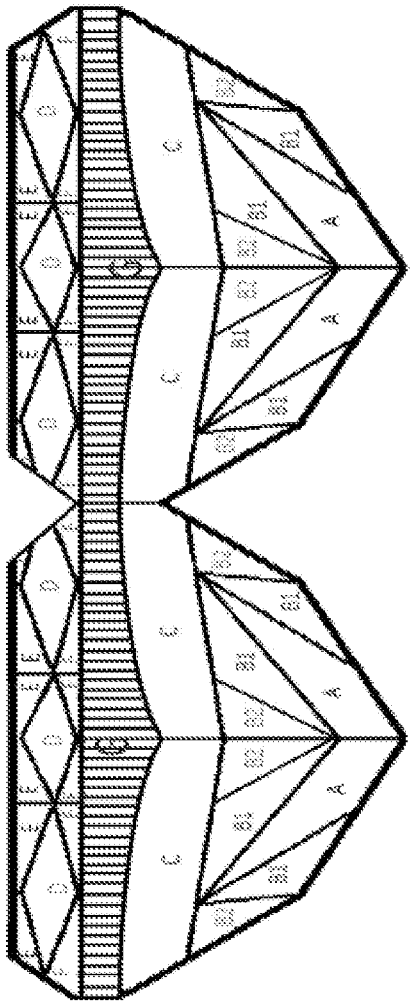
FIG. 40 shows side view of marquise star flower design with six assembled diamonds.

FIGS. 38-40 show the marquise star shaped composite diamond prepared from six diamonds. Below Table 13 shows specification of it.

TABLE 13

| 1 | | 2 | | 3 | |
|---|---|---|---|---|---|
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% |
| L/W RATIO | 1.80 TO 2.00 | L/W RATIO | 1.80 TO 2.00 | L/W RATIO | 1.80 TO 2.00 |
| TOTAL DEPTH | 55% TO 60% | TOTAL DEPTH | 55% TO 60% | TOTAL DEPTH | 55% TO 60% |
| 4 | | 5 | | 6 | |
| A | 28° TO 30° | A | 28° TO 30° | A | 28° TO 30° |
| B1 | 30° TO 32° | B1 | 30° TO 32° | B1 | 30° TO 32° |
| B2 | 30° TO 32° | B2 | 30° TO 32° | B2 | 30° TO 32° |
| C | 55° TO 60° | C | 55° TO 60° | C | 55° TO 60° |
| D | 28° TO 31° | D | 28° TO 31° | D | 28° TO 31° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% |
| L/W RATIO | 1.80 TO 2.00 | L/W RATIO | 1.80 TO 2.00 | L/W RATIO | 1.80 TO 2.00 |
| TOTAL DEPTH | 55% TO 60% | TOTAL DEPTH | 55% TO 60% | TOTAL DEPTH | 55% TO 60% |

Figure 41:
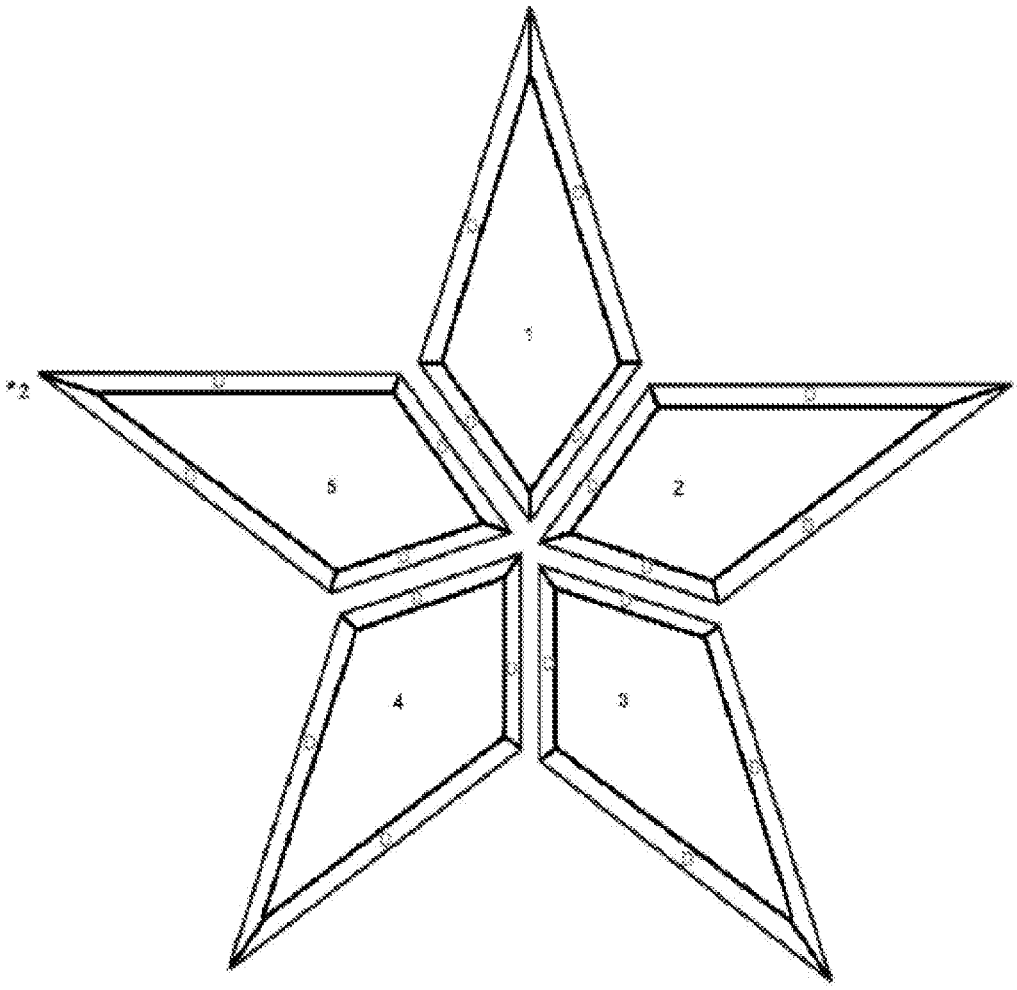
FIG. 41 shows top view of star design with five assembled diamonds.
Figure 42:
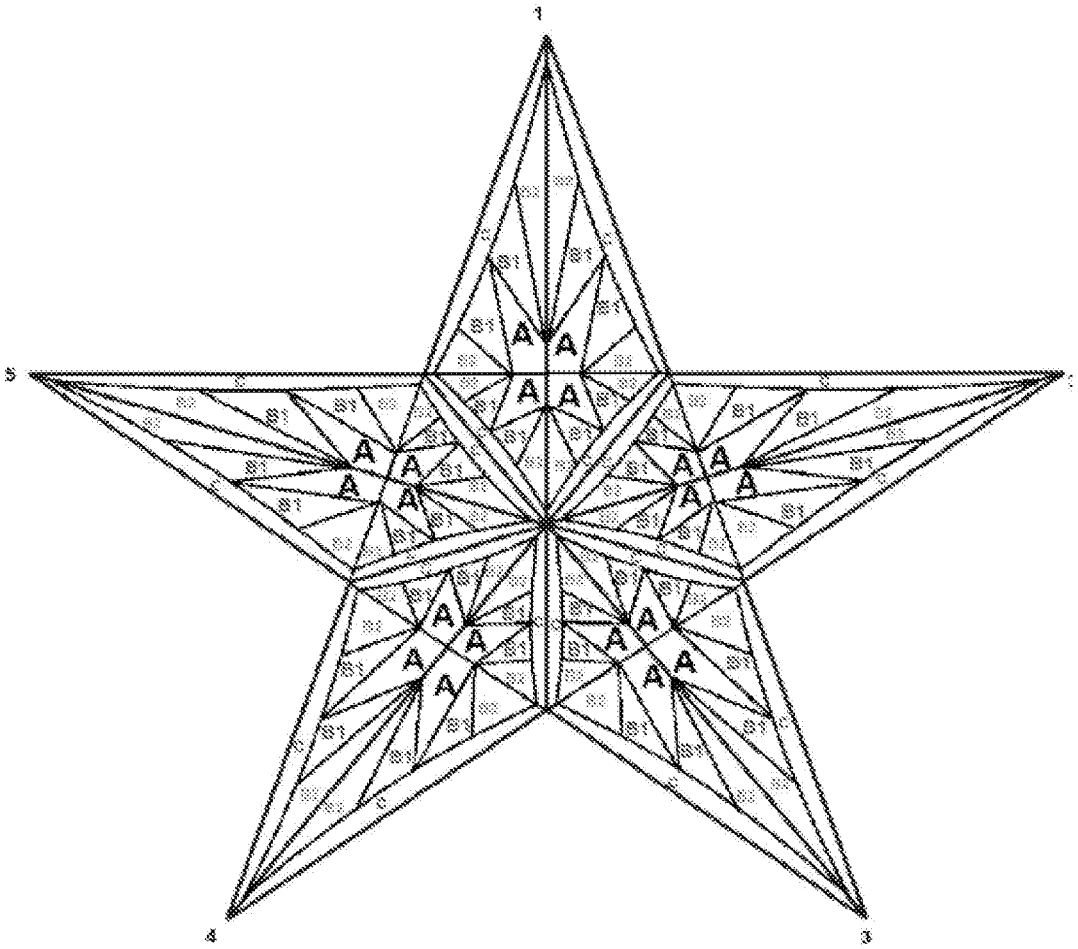
FIG. 42 shows bottom view of star design with five assembled diamonds.
Figure 43:
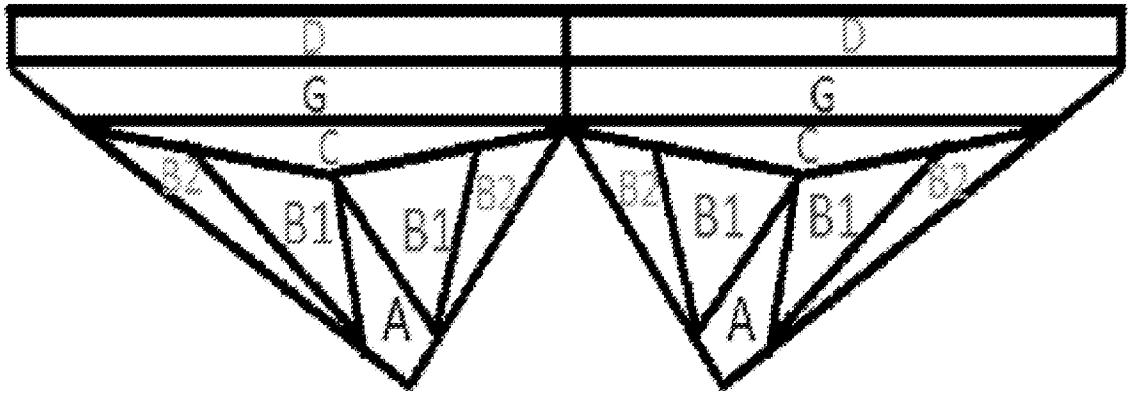
FIG. 43 shows side view of star design with five assembled diamonds.

FIGS. 41-43 show the star shaped composite diamond prepared from five diamonds. Below Table 14 shows specification of it.

TABLE 14

| 1 | | 2 | | 3 | | 4 | | 5 | |
|---|---|---|---|---|---|---|---|---|---|
| A | 28° TO 30° | A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° | C | 55° TO 60° |
| D | 28° TO 31° | D | 28° TO 31° | D | 28° TO 31° | D | 28° TO 31° | D | 28° TO 31° |
| E | — | E | — | E | — | E | — | E | — |
| F | — | F | — | F | — | F | — | F | — |
| G | 90° | G | 90° | G | 90° | G | 90° | G | 90° |
| CROWN | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 1.80 TO 2.30 | L/W RATIO | 1.80 TO 2.30 | L/W RATIO | 1.80 TO 2.30 | L/W RATIO | 1.80 TO 2.30 | L/W RATIO | 1.80 TO 2.30 |
| TOTAL DEPTH | 55% TO 60% | TOTAL DEPTH | 55% TO 60% | TOTAL DEPTH | 55% TO 60% | TOTAL DEPTH | 55% TO 60% | TOTAL DEPTH | 55% TO 60% |

Figure 44:
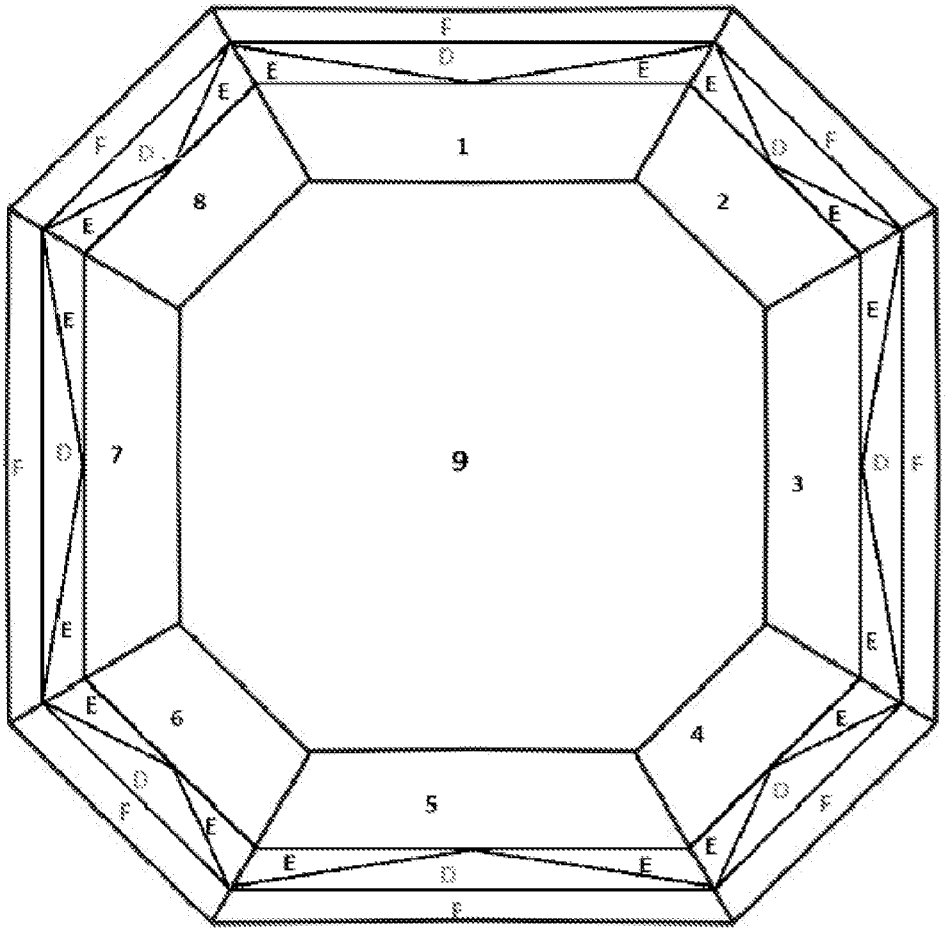
FIG. 44 shows top view of radiant design with nine assembled diamonds.
Figure 45:
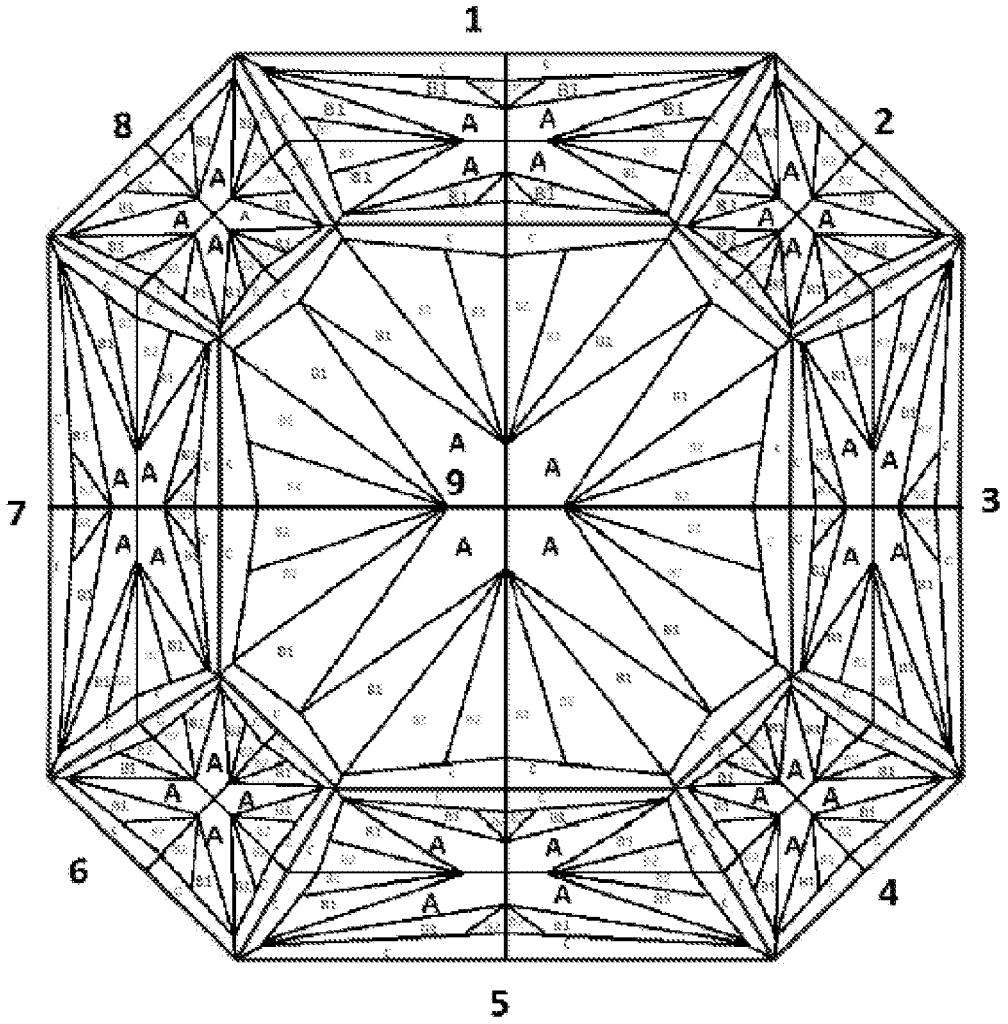
FIG. 45 shows bottom view of radiant design with nine assembled diamonds.
Figure 46:
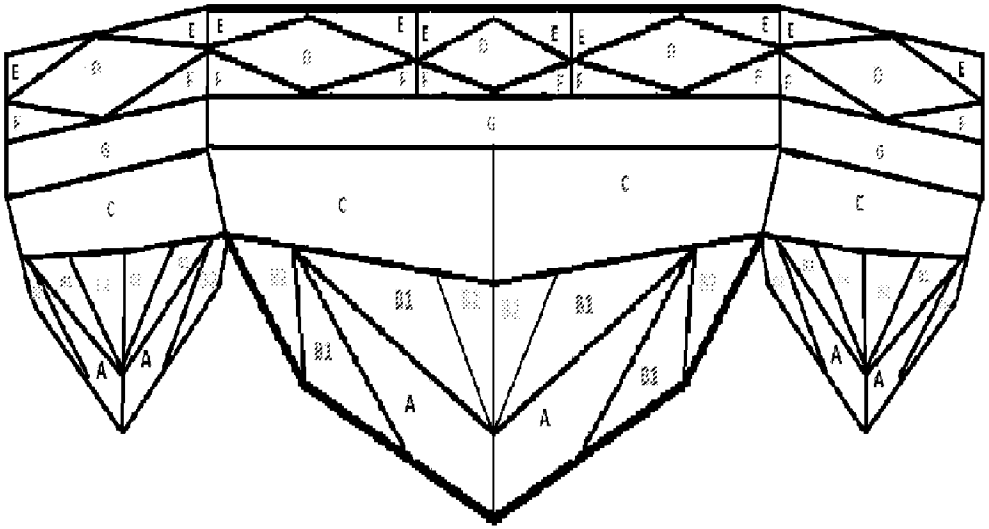
FIG. 46 shows side view of radiant design with nine assembled diamonds.

FIGS. 44-46 show the radiant shaped composite diamond prepared from nine diamonds. Below Table 15 shows specification of it.

TABLE 15

| 1 | | 2 | | 3 | | 4 | | 5 | |
|---|---|---|---|---|---|---|---|---|---|
| A | 28° TO 30° | A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° | C | 55° TO 60° |
| D | 28° TO 31° | D | 28° TO 31° | D | 28° TO 31° | D | 28° TO 31° | D | 28° TO 31° |
| E | 20° TO 25° | E | 20° TO 25° | E | 20° TO 25° | E | 20° TO 25° | E | 20° TO 25° |
| F | 32° TO 35° | F | 32° TO 35° | F | 32° TO 35° | F | 32° TO 35° | F | 32° TO 35° |
| G | 90° | G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 40% TO 45% | PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICK-NESS | 10% TO 15% | GIRDLE THICKNESS | 10% TO 15% | GIRDLE THICK-NESS | 10% TO 15% | GIRDLE THICKNESS | 10% TO 15% |
| L/W RATIO | 0.33 TO 0.35 | L/W RATIO | 0.75 TO 0.80 | L/W RATIO | 0.33 TO 0.35 | L/W RATIO | 0.75 TO 0.80 | L/W RATIO | 0.33 TO 0.35 |
| TOTAL DEPTH | 55% TO 60% | TOTAL DEPTH | 55% TO 60% | TOTAL DEPTH | 55% TO 60% | TOTAL DEPTH | 55% TO 60% | TOTAL DEPTH | 55% TO 60% |

| 6 | | 7 | | 8 | | 9 | |
|---|---|---|---|---|---|---|---|
| A | 28° TO 30° | A | 28° TO 30° | A | 28° TO 30° | A | 28° TO 30° |
| B1 | 30° TO 32° | B1 | 30° TO 32° | B1 | 30° TO 32° | B1 | 30° TO 32° |
| B2 | 30° TO 32° | B2 | 30° TO 32° | B2 | 30° TO 32° | B2 | 30° TO 32° |
| C | 55° TO 60° | C | 55° TO 60° | C | 55° TO 60° | C | 55° TO 60° |
| D | 28° TO 31° | D | 28° TO 31° | D | 28° TO 31° | D | — |
| E | 20° TO 25° | E | 20° TO 25° | E | 20° TO 25° | E | — |
| F | 32° TO 35° | F | 32° TO 35° | F | 32° TO 35° | F | — |
| G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | — |

TABLE 15-continued

| | | | | | | | |
|---|---|---|---|---|---|---|---|
| PAVILION HEIGHT | 40% TO 45% | PAVILION HEIGHT | 40% TO 45% | PAVILION HEIGHT | 40% TO 45% | PAVILION HEIGHT | 40% TO 45% |
| GIRDLE THICKNESS | 10% TO 15% | GIRDLE THICKNESS | 10% TO 15% | GIRDLE THICKNESS | 10% TO 15% | GIRDLE THICKNESS | 10% TO 15% |
| L/W RATIO | 0.75 TO 0.80 | L/W RATIO | 0.33 TO 0.35 | L/W RATIO | 0.75 TO 0.80 | L/W RATIO | 1.00 |
| TOTAL DEPTH | 55% TO 60% | TOTAL DEPTH | 55% TO 60% | TOTAL DEPTH | 55% TO 60% | TOTAL DEPTH | 55% TO 60% |

Figure 47:
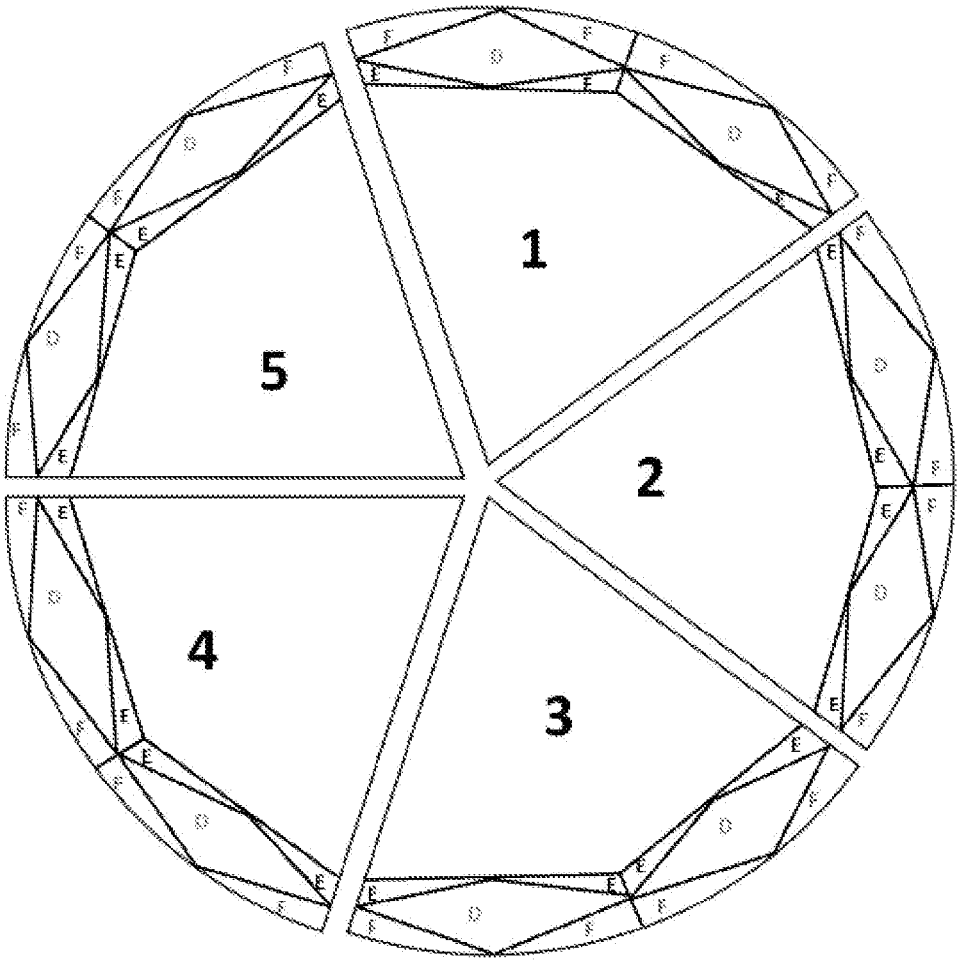
FIG. 47 shows top view of internally embossed round design with five assembled diamonds.
Figure 48:
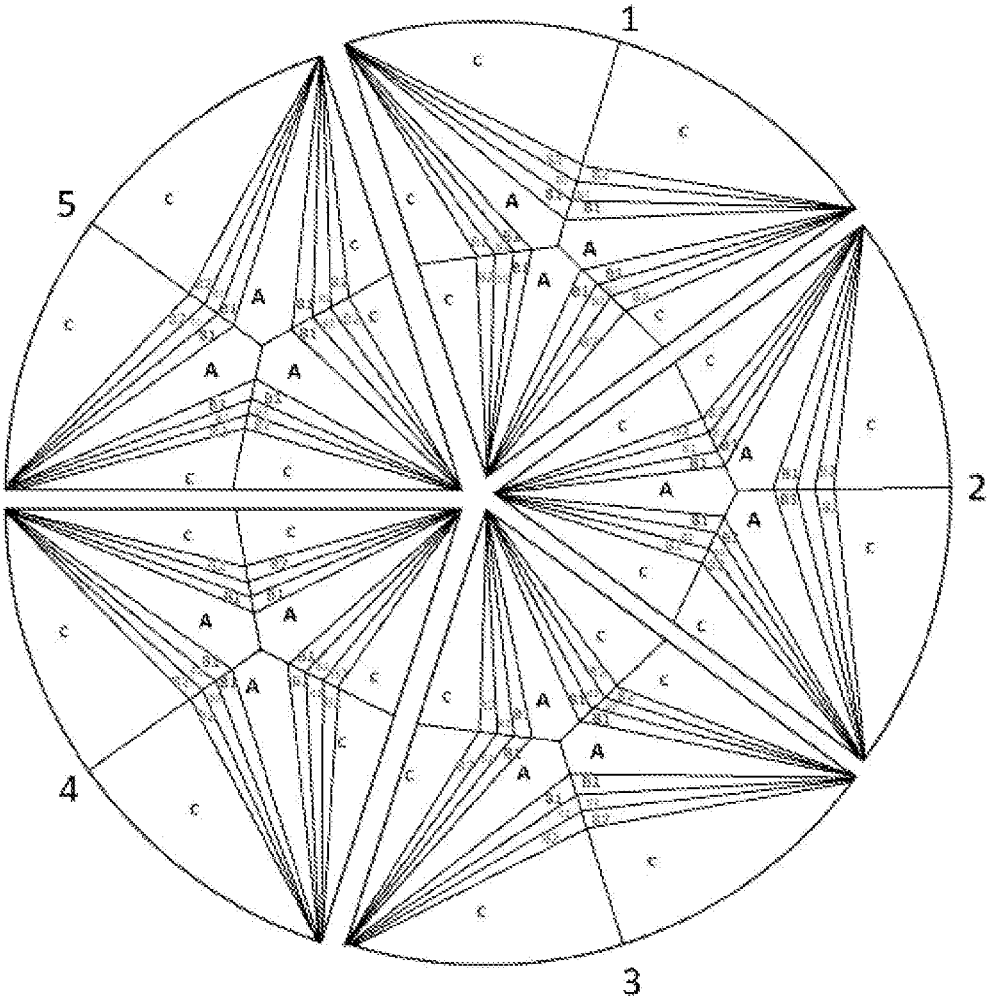
FIG. 48 shows bottom view of internally embossed round design with five assembled diamonds.
Figure 49:
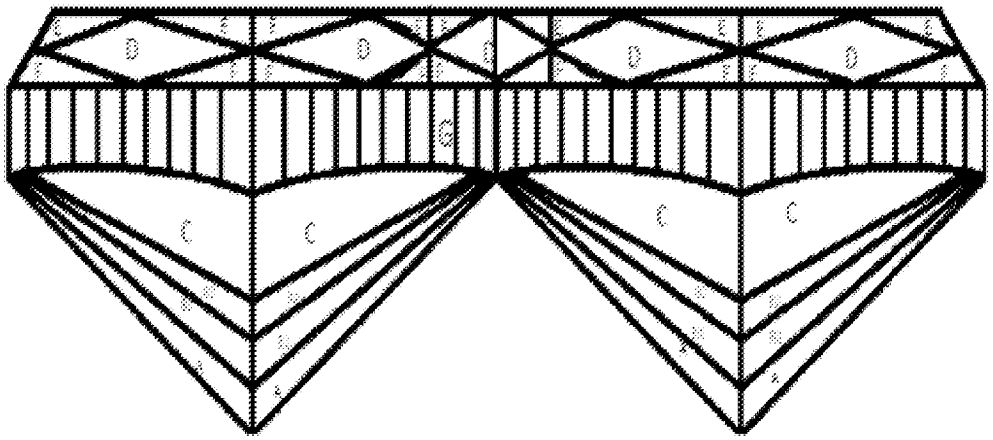
FIG. 49 shows side view of internally embossed round design with five assembled diamonds.

FIGS. 47-49 show the internally embossed round composite diamond prepared from five diamonds. Below Table 16 shows specification of it.

TABLE 16

| 1 | | 2 | | 3 | | 4 | | 5 | |
|---|---|---|---|---|---|---|---|---|---|
| A | 25° TO 27° | A | 25° TO 27° | A | 25° TO 27° | A | 25° TO 27° | A | 25° TO 27° |
| B1 | 27° TO 30° | B1 | 27° TO 30° | B1 | 27° TO 30° | B1 | 27° TO 30° | B1 | 27° TO 30° |
| B2 | 27° TO 30° | B2 | 27° TO 30° | B2 | 27° TO 30° | B2 | 27° TO 30° | B2 | 27° TO 30° |
| C | 55° TO 60° | C | 55° TO 60° | C | 55° TO 60° | C | 55° TO 60° | C | 55° TO 60° |
| D | 28° TO 30° | D | 28° TO 30° | D | 28° TO 30° | D | 28° TO 30° | D | 28° TO 30° |
| E | 20° TO 25° | E | 20° TO 25° | E | 20° TO 25° | E | 20° TO 25° | E | 20° TO 25° |
| F | 32° TO 35° | F | 32° TO 35° | F | 32° TO 35° | F | 32° TO 35° | F | 32° TO 35° |
| G | 90° | G | 90° | G | 90° | G | 90° | G | 90° |
| CROWN HEIGHT | 5% TO 8% | CROWN HEIGHT | 5% TO 8% | CROWN HEIGHT | 5% TO 8% | CROWN HEIGHT | 5% TO 8% | CROWN HEIGHT | 5% TO 8% |
| PAVILION HEIGHT | 28% TO 35% | PAVILION HEIGHT | 28% TO 35% | PAVILION HEIGHT | 28% TO 35% | PAVILION HEIGHT | 28% TO 35% | PAVILION HEIGHT | 28% TO 35% |
| GIRDLE THICKNESS | 11% TO 15% | GIRDLE THICKNESS | 11% TO 15% | GIRDLE THICKNESS | 11% TO 15% | GIRDLE THICKNESS | 11% TO 15% | GIRDLE THICKNESS | 11% TO 15% |
| L/W RATIO | 86 | L/W RATIO | 86 | L/W RATIO | 86 | L/W RATIO | 86 | L/W RATIO | 86 |
| TOTAL DEPTH | 40% TO 45% | TOTAL DEPTH | 40% TO 45% | TOTAL DEPTH | 40% TO 45% | TOTAL DEPTH | 40% TO 45% | TOTAL DEPTH | 40% TO 45% |

Figure 50:
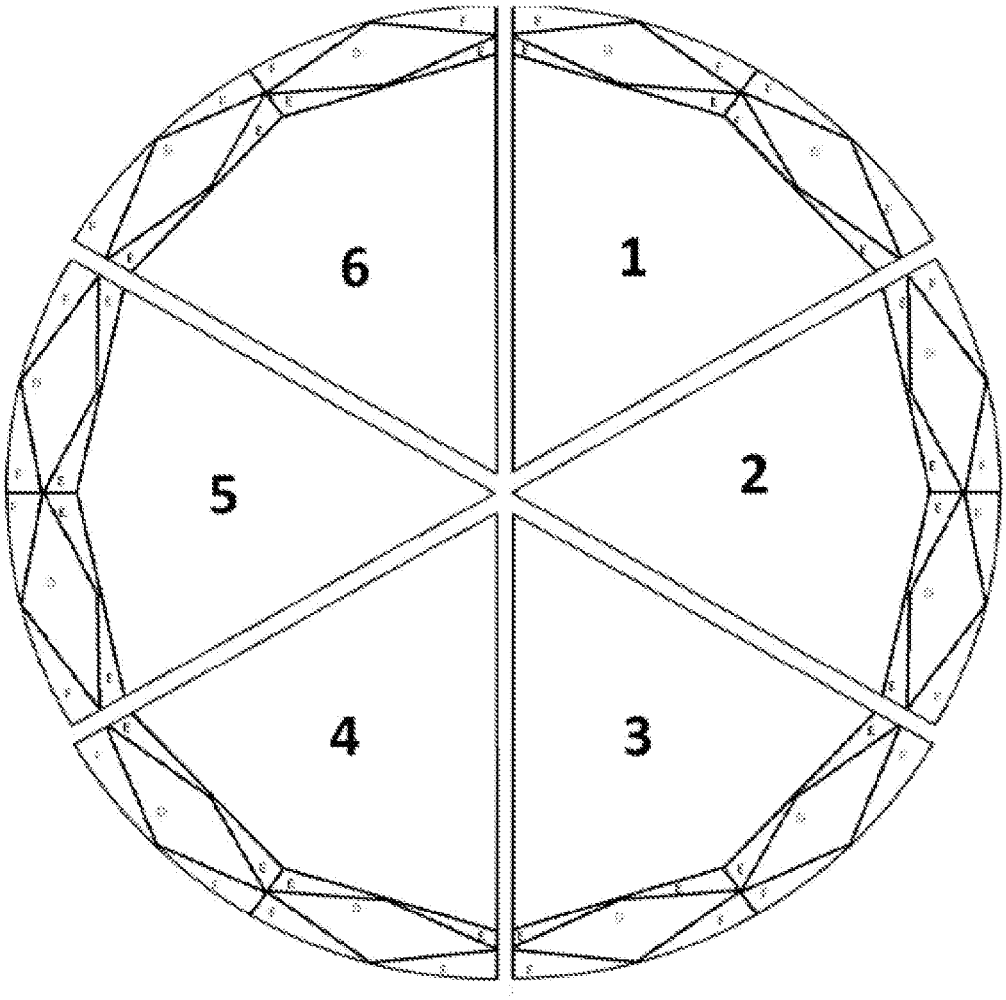
FIG. 50 shows top view of internally embossed round design with six assembled diamonds.
Figure 51:
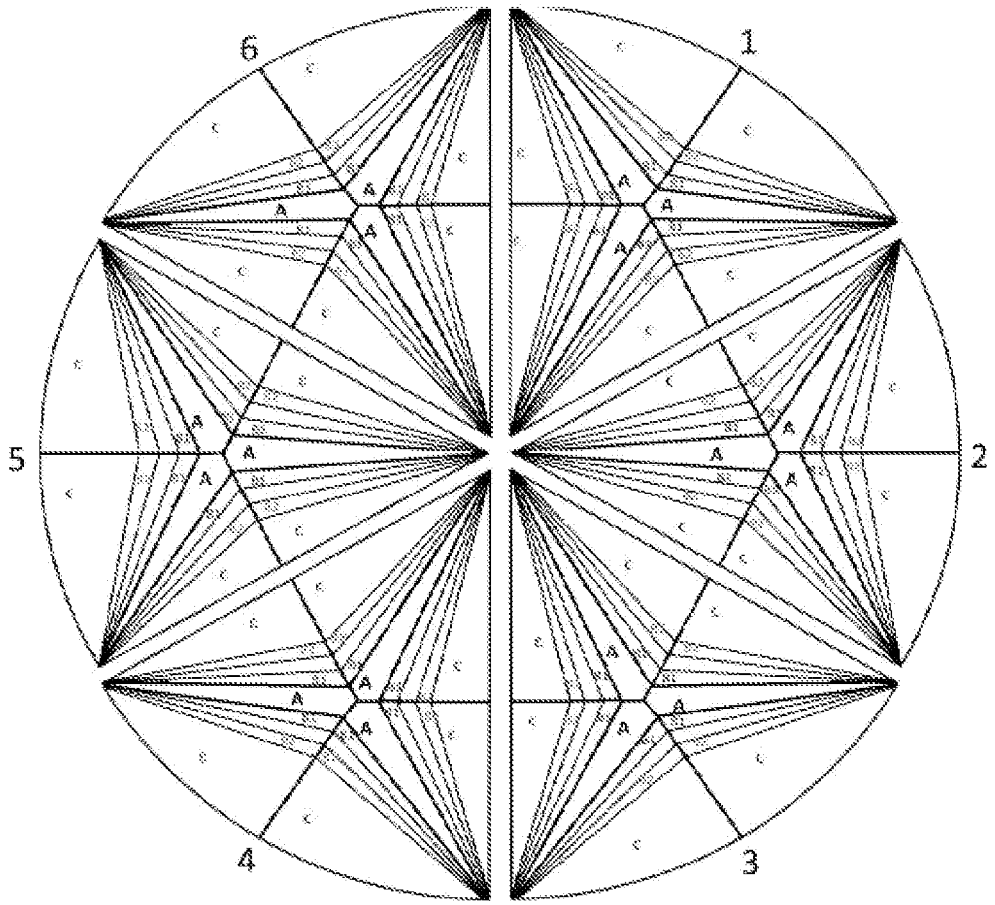
FIG. 51 shows bottom view of internally embossed round design with six assembled diamonds.
Figure 52:
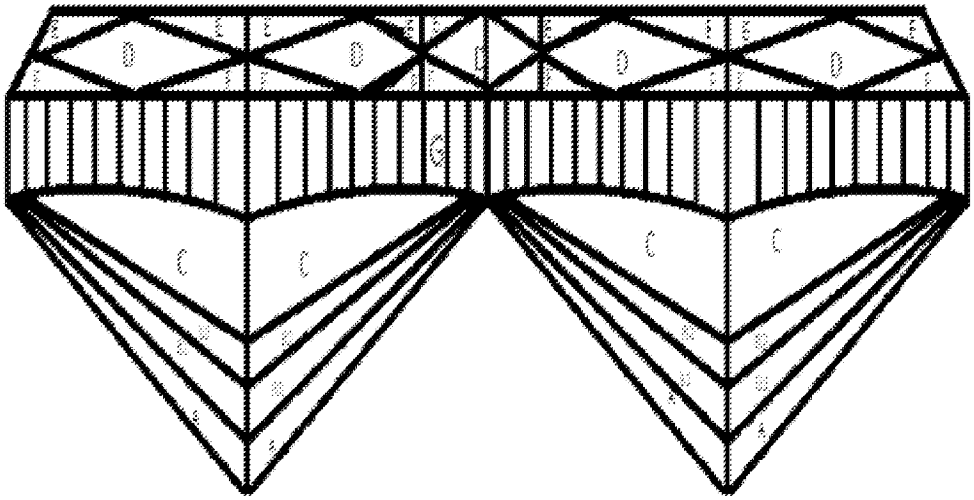
FIG. 52 shows side view of internally embossed round design with six assembled diamonds.

FIGS. 50-52 show the internally embossed round composite diamond prepared from six diamonds. Below Table 17 shows specification of it.

TABLE 17

| 1 | | 2 | | 3 | |
|---|---|---|---|---|---|
| A | 25° TO 27° | A | 25° TO 27° | A | 25° TO 27° |
| B1 | 27° TO 30° | B1 | 27° TO 30° | B1 | 27° TO 30° |
| B2 | 27° TO 30° | B2 | 27° TO 30° | B2 | 27° TO 30° |
| C | 55° TO 60° | C | 55° TO 60° | C | 55° TO 60° |
| D | 28° TO 30° | D | 28° TO 30° | D | 28° TO 30° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |
| CROWN HEIGHT | 5% TO 8% | CROWN HEIGHT | 5% TO 8% | CROWN HEIGHT | 5% TO 8% |
| PAVILION HEIGHT | 28% TO 35% | PAVILION HEIGHT | 28% TO 35% | PAVILION HEIGHT | 28% TO 35% |
| GIRDLE THICKNESS | 11% TO 15% | GIRDLE THICKNESS | 11% TO 15% | GIRDLE THICKNESS | 11% TO 15% |
| L/W RATIO | 1.03 | L/W RATIO | 1.03 | L/W RATIO | 1.03 |
| TOTAL DEPTH | 40% TO 45% | TOTAL DEPTH | 40% TO 45% | TOTAL DEPTH | 40% TO 45% |
| **4** | | **5** | | **6** | |
| A | 25° TO 27° | A | 25° TO 27° | A | 25° TO 27° |
| B1 | 27° TO 30° | B1 | 27° TO 30° | B1 | 27° TO 30° |
| B2 | 27° TO 30° | B2 | 27° TO 30° | B2 | 27° TO 30° |
| C | 55° TO 60° | C | 55° TO 60° | C | 55° TO 60° |
| D | 28° TO 30° | D | 28° TO 30° | D | 28° TO 30° |
| E | 20° TO 25° | E | 20° TO 25° | E | 20° TO 25° |
| F | 32° TO 35° | F | 32° TO 35° | F | 32° TO 35° |
| G | 90° | G | 90° | G | 90° |

TABLE 17-continued

| | | | | | |
|---|---|---|---|---|---|
| CROWN HEIGHT | 5% TO 8% | CROWN HEIGHT | 5% TO 8% | CROWN HEIGHT | 5% TO 8% |
| PAVILION HEIGHT | 28% TO 35% | PAVILION HEIGHT | 28% TO 35% | PAVILION HEIGHT | 28% TO 35% |
| GIRDLE THICKNESS | 11% TO 15% | GIRDLE THICKNESS | 11% TO 15% | GIRDLE THICKNESS | 11% TO 15% |
| L/W RATIO | 1.03 | L/W RATIO | 1.03 | L/W RATIO | 1.03 |
| TOTAL DEPTH | 40% TO 45% | TOTAL DEPTH | 40% TO 45% | TOTAL DEPTH | 40% TO 45% |

The present invention provides various advantages in form of economic significance via combining the small diamonds to give camouflage effect of large diamond.

Another advantage of invention is that it provides effective setting method for natural diamonds, naturally colored and treated color natural diamonds.

While various embodiments of the present invention have been described in details, it is apparent that modification and adaptation of those designs will occur to those skilled in the art. It is expressly understood, however, that such modifications and adaptations are within the spirit and scope of the present invention as set forth in the following claims.

I claim:

1. A process of cutting and assembling diamonds to form composite diamond having enhanced brilliance and shade, where the diamonds are assorted based on color, blocked based on design and mapped based on maximum raw material utilization comprising following steps:

(a) cutting the diamond in a crown (Cw), a girdle (G) and a pavilion (P), wherein cutting the pavilion (P) of diamond in at least three main facets (A) within the angle degree of 25° to 30° relative to flat facet (T) of the crown (Cw), at least three secondary facets (B1, B2) between two main facets (A) within the angle degree of 27° to 32° relative to flat facet (T) of the crown (Cw) and at least one tertiary facets (C) within the angle degree of 55° to 60° relative to flat facet (T) of the crown (Cw) on at least one of the periphery, wherein cutting the crown (Cw) of diamond in flat facet (T) and at least one main facet (D) within the angle degree of 28° to 31° relative to flat facet (T) of the crown (Cw) on at least one of the periphery;

(b) polishing the diamond obtained in step (a) to have facet on crown (Cw) and pavilion (P) at specific angle that provides cumulative reflection in all diamonds; and (c) grooving the polished diamonds obtained in step (b) and fastening diamonds through fastening means;

(d) arranging the diamond having at least straight edges girdle (G) of opposite diamond together, wherein at least three diamonds held adjacent to each other along a respective single straight edge of the each girdle (G) the diamonds;

(e) adhering the diamonds obtained from step (d).

2. The process of cutting and assembling diamonds to form composite diamond having enhanced brilliance and shade as claimed in claim 1 wherein diamonds are white, naturally colored and treated color natural diamonds.

3. The process of cutting and assembling diamonds to form composite diamond having enhanced brilliance and shade as claimed in claim 1 wherein step (a) wherein secondary facets (B1, B2) are either angularly pointed toward the main facets (A) or toward the periphery.

4. The process of cutting and assembling diamonds to form composite diamond having enhanced brilliance and shade as claimed in claim 1 wherein step (a) optionally the crown (Cw) of diamond of the subject invention is cut to have flat facet (T), at least one main facets (D) having at least one angle in contact with the flat facet (T), two secondary facets (E) between the flat facet (T) and the main facet (D) and at least one tertiary facet (F) on the periphery.

5. The process of cutting and assembling diamonds to form composite diamond having enhanced brilliance and shade as claimed in claim 1 wherein he secondary facets (E) of the crown (Cw) of the diamond are cut within the angle degree of 20° to 25° relative to flat facet (T) of the crown (Cw).

6. The process of cutting and assembling diamonds to form composite diamond having enhanced brilliance and shade as claimed in claim 1 wherein the tertiary facets (F) of the crown (Cw) of the diamond are cut within the angle degree of 32° to 35° relative to flat facet (T) of the crown (Cw).

7. The process of cutting and assembling diamonds to form composite diamond having enhanced brilliance and shade as claimed in claim 1 wherein the crown (Cw) height of the diamond ranges from 5 to 8% of the circumference.

8. The process of cutting and assembling diamonds to form composite diamond having enhanced brilliance and shade as claimed in claim 1 wherein the pavilion (P) height of the diamond ranges from 28 to 45% of the circumference.

9. The process of cutting and assembling diamonds to form composite diamond having enhanced brilliance and shade as claimed in claim 1 wherein the girdle (G) thickness of the diamond ranges from 10 to 15% of the circumference.

10. The process of cutting and assembling diamonds to form composite diamond having enhanced brilliance and shade as claimed in claim 1 step (d) wherein optionally the diamond having at least one straight edges girdle (G) and at least one tertiary facet (C) of the pavilion are placed together.

11. The process of cutting and assembling diamonds to form composite diamond having enhanced brilliance and shade as claimed in claim 1 wherein step (e) is performed by fastening all polished diamond in specific arrangement to have the final product.

* * * * *